US010532352B2

(12) United States Patent
Cooney et al.

(10) Patent No.: US 10,532,352 B2
(45) Date of Patent: Jan. 14, 2020

(54) SAMPLE ANALYSIS SYSTEM

(71) Applicant: AKONNI BIOSYSTEMS, INC., Frederick, MD (US)

(72) Inventors: Christopher G. Cooney, Ellicott City, MD (US); Phillip Belgrader, Livermore, CA (US); Arial Bueno, Frederick, MD (US); Steve Garber, Elkridge, MD (US); Nitu Harshendu Thakore, Ellicott City, MD (US); Peter Qiang Qu, Stanford, CA (US)

(73) Assignee: Akonni Biosystems, Inc., Frederick, MD (US)

( * ) Notice: Subject to any disclaimer, the term of this patent is extended or adjusted under 35 U.S.C. 154(b) by 0 days.

(21) Appl. No.: 16/374,470

(22) Filed: Apr. 3, 2019

(65) Prior Publication Data

US 2019/0224668 A1 Jul. 25, 2019

Related U.S. Application Data

(63) Continuation of application No. 13/314,734, filed on Dec. 8, 2011, now Pat. No. 10,300,482.
(Continued)

(51) Int. Cl.
*B01L 3/00* (2006.01)
*B01L 7/00* (2006.01)

(52) U.S. Cl.
CPC ..... *B01L 3/5025* (2013.01); *B01L 3/50855* (2013.01); *B01L 7/52* (2013.01);
(Continued)

(58) Field of Classification Search
CPC ..... B01L 3/5025; B01L 7/52; B01L 3/50855; B01L 2400/065; B01L 2200/0678;
(Continued)

(56) References Cited

U.S. PATENT DOCUMENTS 5,388,614 A 2/1995 Hakamada et al.
5,741,700 A 4/1998 Ershov et al.
(Continued)

FOREIGN PATENT DOCUMENTS

CA 2 703 950 5/2009
CN 101883619 11/2010
(Continued)

OTHER PUBLICATIONS

European Search Report dated May 8, 2018 in European application No. EP i 1 84 7744.
(Continued)

*Primary Examiner* — Dean Kwak
(74) *Attorney, Agent, or Firm* — Michael X. Ye; Morris, Manning & Martin, LLP

(57) ABSTRACT

An integrated sample analysis system is disclosed. The sample analysis system contains (1) a sample preparation/analysis module having sample purification device comprising a monolith that binds specifically to nucleic acids and a sample analysis device comprising a microarray enclosed in a reaction chamber having a hydrophilic interior surface; (2) a temperature control module comprising a thermocycler having a thermally conductive temperature-control bladder; and (3) an imaging device capable of capturing an image of the microarray in the reaction chamber.

3 Claims, 14 Drawing Sheets

Related U.S. Application Data

(60) Provisional application No. 61/421,414, filed on Dec. 9, 2010.

(52) U.S. Cl.
CPC ..... *B01L 3/502715* (2013.01); *B01L 2200/04* (2013.01); *B01L 2200/0678* (2013.01); *B01L 2200/16* (2013.01); *B01L 2300/044* (2013.01); *B01L 2300/0636* (2013.01); *B01L 2300/0672* (2013.01); *B01L 2300/087* (2013.01); *B01L 2300/0819* (2013.01); *B01L 2300/0829* (2013.01); *B01L 2400/0487* (2013.01); *B01L 2400/065* (2013.01); *B01L 2400/0683* (2013.01)

(58) Field of Classification Search
CPC ..... B01L 2200/026; B01L 2200/10; B01L 2300/0681; B01L 3/502715; B01L 2300/0636; B01L 2300/0816; B01L 2300/087; B01L 2200/0684; B01L 2300/069; B01L 2300/0819; B01L 2300/161; B01L 2400/0406; B01L 2200/16; B01L 2300/044; B01L 2300/0672; B01L 2300/0829; B01L 2400/0622; B01L 2400/0683; B01L 3/502784; B01L 7/525; C12Q 1/6837; C12Q 1/68; C12Q 1/6806; C12Q 1/6813; C12Q 1/6844; B01J 2219/00644; B01J 2219/00722
USPC ..... 422/62, 63, 81, 82, 105, 403, 501, 509, 422/511, 513; 436/43, 180; 251/7, 213, 251/215, 218, 226, 289, 293, 325, 330, 251/335.1, 339, 349, 351
See application file for complete search history.

(56) References Cited

U.S. PATENT DOCUMENTS

| | | | | |
|---|---|---|---|---|
| 5,770,721 | A | 6/1998 | Ershov et al. | |
| 5,981,734 | A | 11/1999 | Mirzabekov et al. | |
| 6,656,725 | B2 | 12/2003 | Mirzabekov et al. | |
| 6,687,936 | B2 * | 2/2004 | Graebe | A47C 27/081 5/710 |
| 7,570,443 | B2 | 8/2009 | Blasenheim et al. | |
| 7,955,840 | B2 | 6/2011 | Belgrader | |
| 7,955,841 | B2 | 6/2011 | Belgrader | |
| 8,071,035 | B2 * | 12/2011 | Elizarov | B01J 19/0093 422/129 |
| 9,121,058 | B2 | 9/2015 | Stern et al. | |
| 2003/0175820 | A1 | 9/2003 | Smith et al. | |
| 2004/0189311 | A1 | 9/2004 | Glezer et al. | |
| 2005/0075482 | A1 | 4/2005 | Tanaka et al. | |
| 2005/0095624 | A1 | 5/2005 | Kim et al. | |
| 2005/0226772 | A1 * | 10/2005 | Ririe | B01L 3/502 422/68.1 |
| 2006/0246490 | A1 | 11/2006 | Anderson et al. | |
| 2008/0287661 | A1 | 11/2008 | Jones | |
| 2009/0111193 | A1 | 4/2009 | Cooney et al. | |
| 2009/0221431 | A1 | 9/2009 | Yoo | |
| 2009/0298129 | A1 | 12/2009 | Spence et al. | |
| 2010/0015646 | A1 | 1/2010 | Johnson et al. | |
| 2010/0144558 | A1 | 6/2010 | Zenhausern et al. | |
| 2010/0284859 | A1 | 11/2010 | Cooney et al. | |
| 2010/0291668 | A1 | 11/2010 | Bertrand et al. | |
| 2012/0004143 | A2 * | 1/2012 | Belgrader | B01L 3/502715 506/39 |
| 2012/0077260 | A1 | 3/2012 | Sharon et al. | |
| 2014/0161686 | A1 | 6/2014 | Bort et al. | |
| 2016/0318017 | A1 | 11/2016 | Eltoukhy et al. | |

FOREIGN PATENT DOCUMENTS

| | | |
|---|---|---|
| WO | 2009/058414 | 5/2009 |
| WO | 2009136892 | 11/2009 |
| WO | 2010132834 | 11/2010 |

OTHER PUBLICATIONS

International Preliminary Report on Patentability and Written Opinion of the International Searching Authority issued in International Patent Application No. PCT/US2011/ 063937, dated Jun. 20, 2013.
Leland, Diane S., et al., "Role of Cell Culture for Virus Detection in the Age of Technology", Clinical Microbiology Reviews, vol. 20, No. 1, pp. 49-78 (Jan. 2007).

* cited by examiner

SAMPLE ANALYSIS SYSTEM

This application is a continuation application of U.S. patent application Ser. No. 13/314,734, filed on Dec. 8, 2011, which claims priority to U.S. Provisional Application No. 61/421,414, filed on Dec. 9, 2010. The entirety of all of the aforementioned application is incorporated by reference.

FIELD

The present application relates generally to sample analysis systems and, in particular, to an integrated sample-to-answer analysis system for detection of biological materials in a sample.

BACKGROUND

Molecular testing is a test carried out at the molecular level for detection of biological materials, such as DNA, RNA and/or proteins, in a test sample. Molecular testing is beginning to emerge as a gold standard due to its speed, sensitivity and specificity. For example, molecular assays were found to be 75% more sensitive than conventional cultures when identifying enteroviruses in cerebrospinal fluid and are now considered the gold standard for this diagnostic (Leland et al., Clin. Microbiol Rev. 2007, 20:49-78)

Microarrays are most prevalent in research laboratories as tools for profiling gene expression levels because thousands of probes can interrogate a single sample. Microarrays have not been widely adopted by clinical laboratories in molecular testing because of their operational complexity and cost (often hundreds of dollars per test). The high cost of microarray tests are due to three fundamental limitations: (1) the multi-step manufacturing process that often relies on photolithography (2) the device assembly, which frequently consist of glass or silicon substrates, and sometimes contains complex microfluidic designs to execute long sequence of steps, and/or (3) the labor associated with running these high complexity tests. Therefore, there exists a need for developing more cost effective methods and devices for performing molecular tests using microarray technology.

SUMMARY

One aspect of the present application relates to a disposable reaction cassette for a sample analysis device. The disposable reaction cassette comprises a plurality of containers and a flow strip. Each container has an open top end and a closed bottom end. At least one of the plurality of containers is pre-packaged with a reagent needed for a sample analysis procedure and is sealed with a removable or pierceable cover at the top end of the container. The flow strip comprises a plurality of ports and one or more reaction chambers connected to one or more ports. Each reaction chamber comprises a microarray. The plurality of ports interact with the sample analysis device via one or more fluid communication devices to establish fluid communication between the plurality of ports and the sample analysis device.

Another aspect of the present application relates to a flow strip. The flow strip comprises a plurality of ports and a plurality of reaction chambers. Each port comprises a pierceable septum or a dome valve for establishing fluid communication with a sample purification device. Each reaction chamber contains a microarray and is connected to a port.

Another aspect of the present application relates to a flow control manifold. The flow control manifold comprises a manifold body, a plurality of fluid supply ports that are formed on the manifold body and are adapted to be connected to a fluid supply device, a plurality of plunger channels formed within the manifold body, and a plurality of plungers that are movable along the length of the plunger channels. Each plunder channel has a plunger channel inlet at one end and a plunger channel outlet at another end. Each plunger comprises a seal that seals against the interior wall of the plunger channel in which the plunger is located. The plungers enter the plunger channels from the plunger channel inlets. Each of the plurality of fluid supply ports is connected to a plunger channel at a location in the proximity of the plunger channel inlet of the plunger channel.

Another aspect of the present application relates to a flow-control selector. The flow-control selector comprises a selector channel having a plurality of outlet ports, and a linear motion actuator comprising an elongated shaft and a motor that controls the linear movement of the shaft. The elongated shaft has a proximal end, a distal end, and an enclosed fluid communication channel within the shaft. The fluid communication channel extends from a first opening at the proximal end of the shaft to a second opening at the distal end of the shaft. The first opening is adapted to be connected to a fluid source, and the second opening is flanked by two seals on the shaft such that when the shaft is placed in the selector channel, the two seals seal against the interior wall of the selector channel and form a fluid communication passage between the two seals. A fluid communication is established between the fluid source and an outlet port of the flow-control selector when the fluid communication passage is formed between the second opening and the outlet port.

Another aspect of the present application relates to an integrated sample analysis system. The system comprises (1) a sample preparation/analysis module comprising a sample purification device comprising a monolith that binds specifically to nucleic acids, and a sample analysis device comprising a microarray enclosed in a reaction chamber having a hydrophilic interior surface; (2) a temperature control module comprising a thermocycler comprising a thermally conductive temperature-control bladder, the bladder being configured such that, upon receiving the temperature-control substance, the bladder expands to abut an exterior surface of the reaction chamber to enable thermal exchange between the temperature-control substance and the internal volume of the reaction chamber; and (3) an imaging device positioned to capture an image of the microarray in the reaction chamber.

BRIEF DESCRIPTION OF DRAWINGS

For the purposes of this disclosure, unless otherwise indicated, identical reference numerals used in different figures refer to the same component.

DETAILED DESCRIPTION

Figure 1:
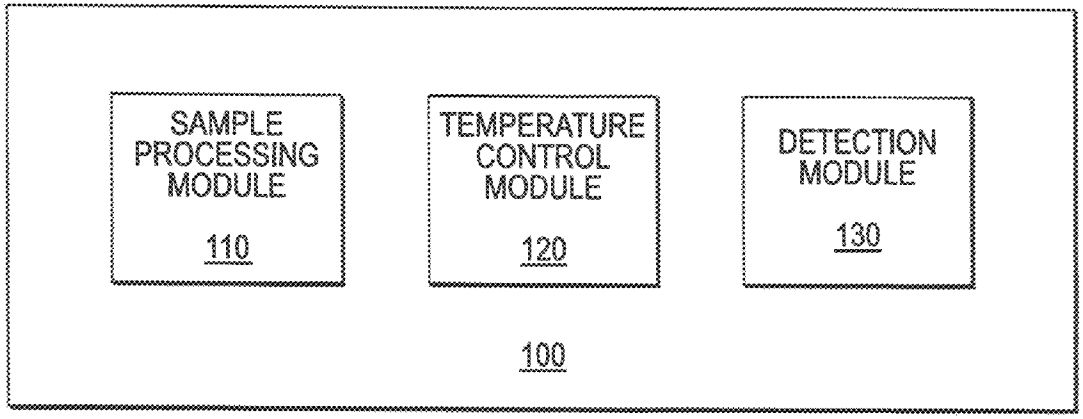
FIG. 1 is a diagram of the sample detection system of the present invention.

The following detailed description is presented to enable any person skilled in the art to make and use the invention. For purposes of explanation, specific nomenclature is set forth to provide a thorough understanding of the present application. However, it will be apparent to one skilled in the art that these specific details are not required to practice the invention. Description of specific embodiments and applications is provided only as representative examples. This description is an exemplification of the principles of the invention and is not intended to limit the invention to the particular embodiments illustrated.

This description is intended to be read in connection with the accompanying drawings, which are considered part of the entire written description of this invention. The drawing figures are not necessarily to scale and certain features of the invention may be shown exaggerated in scale or in somewhat schematic form in the interest of clarity and conciseness. In the description, relative terms such as "front," "back" "up," "down," "top" and "bottom," as well as derivatives thereof, should be construed to refer to the orientation as then described or as shown in the drawing figure under discussion. These relative terms are for convenience of description and normally are not intended to require a particular orientation. Terms concerning attachments, coupling and the like, such as "connected" and "attached," refer to a relationship wherein structures are secured or attached to one another either directly or indirectly through intervening structures, as well as both movable or rigid attachments or relationships, unless expressly described otherwise.

As used herein, the term "sample" includes biological samples such as cell samples, bacterial samples, virus samples, samples of other microorganisms, samples obtained from a mammalian subject, preferably a human subject, such as tissue samples, cell culture samples, stool samples, and biological fluid samples (e.g., blood, plasma, serum, saliva, urine, cerebral or spinal fluid, lymph liquid and nipple aspirate), environmental samples, such as air samples, water samples, dust samples and soil samples.

The term "monolith," "monolith adsorbent" or "monolithic adsorbent material," as used in the embodiments described hereinafter, refers to a porous, three-dimensional adsorbent material having a continuous interconnected pore structure in a single piece. A monolith is prepared, for example, by casting, sintering or polymerizing precursors into a mold of a desired shape. The term "monolith" is meant to be distinguished from two or more filters that are placed next to each other or pressed against each other. The term "monolith adsorbent" or "monolithic adsorbent material" is meant to be distinguished from a collection of individual adsorbent particles packed into a bed formation or embedded into a porous matrix, in which the end product comprises individual adsorbent particles. The term "monolith adsorbent" or "monolithic adsorbent material" is also meant to be distinguished from a collection of adsorbent fibers or fibers coated with an adsorbent, such as filter papers or filter papers coated with an adsorbent.

The term "specifically bind to" or "specific binding," as used in the embodiments described hereinafter, refers to the binding of the adsorbent to an analyte (e.g., nucleic acids) with a specificity that is sufficient to differentiate the analyte from other components (e.g., proteins) or contaminants in a sample. In one embodiment, the term "specific binding" refers to the binding of the adsorbent to an analyte in a sample with a binding affinity that is at least 10-fold higher than the binding affinity between the adsorbent and other components in the sample. A person of ordinary skill in the art understands that stringency of the binding of the analyte to the monolith and elution from the monolith can be controlled by binding and elution buffer formulations. For example, elution stringencies for nucleic acids can be controlled by salt concentrations using KCl or NaCl. Nucleic acids, with their higher negative charge, are more resistant to elution than proteins. Temperature, pH, and mild detergent are other treatments that could be used for selective binding and elution. Thermal consistency of the binding and elution may be maintained with a heat block, water bath, infrared heating, and/or heated air directed at or in the solution. The manipulation of the binding buffer is preferable since the impact of the modified elution buffer on the downstream analyzer would need to be evaluated.

The term "nucleic acid," as used in the embodiments described hereinafter, refers to individual nucleic acids and polymeric chains of nucleic acids, including DNA and RNA, whether naturally occurring or artificially synthesized (including analogs thereof), or modifications thereof, especially those modifications known to occur in nature, having any length. Examples of nucleic acid lengths that are in accord with the present invention include, without limitation, lengths suitable for PCR products (e.g., about 50 to 700 base pairs (bp)) and human genomic DNA (e.g., on an order from about kilobase pairs (Kb) to gigabase pairs (Gb)). Thus, it will be appreciated that the term "nucleic acid" encompasses single nucleic acids as well as stretches of nucleotides, nucleosides, natural or artificial, and combinations thereof, in small fragments, e.g., expressed sequence tags or genetic fragments, as well as larger chains as exemplified by genomic material including individual genes and even whole chromosomes. The term "nucleic acid" also encompasses peptide nucleic acid (PNA) and locked nucleic acid (LNA) oligomers.

The term "hydrophilic surface" as used herein, refers to a surface that would form a contact angle of 45° or smaller with a drop of pure water resting on such a surface. The term "hydrophobic surface" as used herein, refers to a surface that would form a contact angle greater than 45° with a drop of pure water resting on such a surface. Contact angles can be measured using a contact angle goniometer.

The term "pierceable seal" or "pierceable cover" as used herein, refers to a seal or cover that is pierceable by a liquid communication device, such as a pipette tip, during normal operation of the sample analysis system of the present application. Examples of a pierceable seal or cover include, but are not limited to, membranes, films, rubber (e.g., silicone) mats with slits or foils that are attached to the opening of a tube or container with heat sealing, an adhesive, or crimping. The pierceable seal or cover allows packaging of liquid reagents in the cassette of the present invention. It also allows for packaging of lyophilized reagents with sufficient moisture barriers to protect the lyophilized reagents from liquid reagents in the same cassette.

Integrated Sample-to-Answer Sample Analysis System

One aspect of the instant application relates to an integrated sample-to-answer sample analysis system 100 for the detection of a biomolecule, such as DNA, RNA or protein. In certain embodiments, the system 100 comprise a sample processing module 110, a temperature control module 120 and a detection module 130 (FIG. 1).

The sample processing module 110 prepares a sample for analysis. Such preparation typically involves purification or isolation of the molecules of interest, such as DNA, RNA or protein, from the original sample using a sample purification device. In some embodiments, the sample purification device is a pipette tip containing a filter that binds specifically to the molecules of interest. Examples of such filters are described in more details in U.S. Pat. No. 7,785,869 and U.S. patent application Ser. No. 12/213,942, both of which are hereby incorporated by reference in their entirety.

Figure 2:
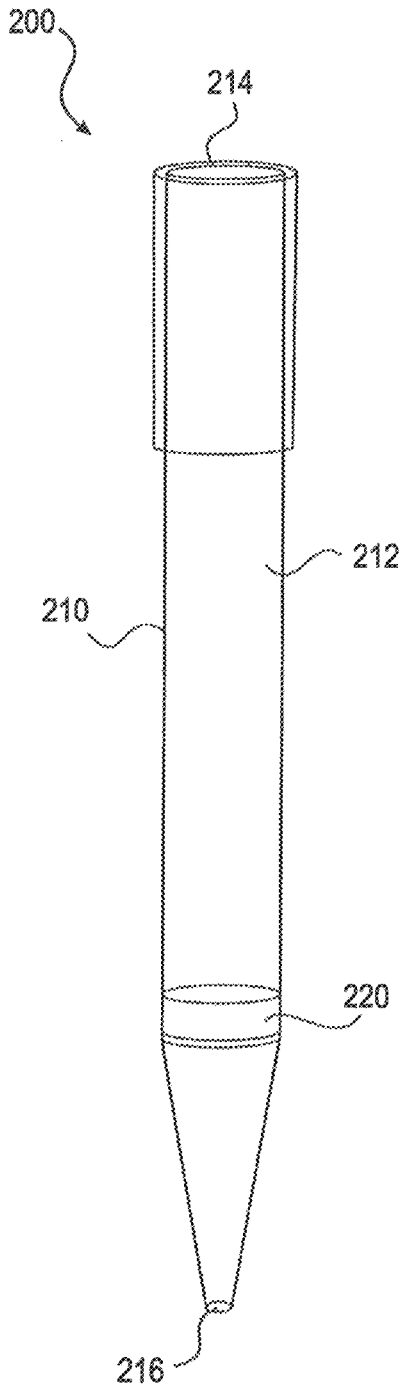
FIG. 2 is a diagram showing a sample preparation system of the present application.

FIG. 2 shows an embodiment of a sample purification device 200 that comprises a housing 210 and a sample filter 220. The housing 210 defines a sample passage way 212 between a first opening 214 and a second opening 216. The shape and size of the housing 210 are not particularly limited. In this embodiment, the preferred housing configuration is substantially cylindrical so that the flow vectors during operation are substantially straight. In the embodiment shown in FIG. 2, the housing 210 has a pipette tip geometry, i.e., the first opening 214 has a diameter that is greater than the diameter of said second opening 216, and the first opening 214 is dimensioned to fit onto the tip of a pipette. The sample filter 220 is placed in the close proximity of the second opening 216 so that samples are filtered immediately after being taken into the housing 210 through the second opening 216. In one embodiment, the sample filter 220 is contiguous with the second opening 216. In another embodiment, the sample filter 220 is separated from the second opening 216 by a distance of 1-20 mm. In some embodiments, the monolith sample filter is a glass frit with a average pore size of 20-200 micron. In another embodiment, the sample filter 220 is a monolith filter with two sections having different porosities: a first section 221 at the proximity of the second opening 216 and a second section 222 that is separated from the second opening 216 by the first section 221. In one embodiment, the first section has an average pore size of 40-200 micron, preferably 40-60 micron, and the second section has an average pore size of 1-40 micron, preferably 1-20 micron.

In another embodiment, the sample processing module 110 comprises an affinity column filed with a medium that binds specifically to the molecules of interest. The sample processing module 110 may further comprise a fluid handling device, such as an automatic pipette or a pump to transport liquid samples. The processed sample, which is enriched for the molecules of interest, is then transported to a reaction chamber and is subjected to an amplification reaction or a binding reaction for the detection of a molecule of interest in the sample. In some embodiments, the reaction chamber contains a microarray and is located within a flow cell (also referred to as a "biochip"), as described in U.S. patent application Ser. Nos. 12/149,865 and 12/840,826, both of which are hereby incorporated by reference in their entirety. Briefly, the flow cell contains a microarray formed on a planar substrate and a reaction chamber formed around the microarray.

The microarray can be a polynucleotide array or a protein/peptide array. In one embodiment, the microarray is formed using the printing gel spots method described in e.g., U.S. Pat. Nos. 5,741,700, 5,770,721, 5,981,734, 6,656,725 and U.S. patent application Ser. Nos. 10/068,474, 11/425,667 and 60/793,176, all of which are hereby incorporated by reference in their entirety. The planar substrate can be glass or plastic (films and injection molded) in black, white, clear, or other colors.

The reaction chamber has a plurality of interior surfaces including a bottom surface on which the microarray is formed and a top surface that faces the bottom surface and is generally parallel to the bottom surface. At least one of the plurality of interior surfaces is a hydrophilic surface that facilitate the complete filling of the reaction chamber. In one embodiment, the top surface of the reaction chamber is a hydrophilic surface. In some embodiments, the flow cell further comprises a pierceable and re-sealable septum, such as a dome valve for loading a liquid sample into the reaction chamber and a sample channel connecting the one-way valve to the reaction chamber. In other embodiments, the reaction chamber is connected to a waste chamber or an absorbent via a waste channel.

In some other embodiments, the sample processing module 110 further comprises a cell lysis chamber having a plurality of cell lysis beads and a magnetic stirrer. Cell lysis is achieved by rotating the magnetic stirrer inside the cell lysis chamber in the presence of the cell lysis beads. The rotation of the magnetic stirrer can be caused by creating a rotating magnetic field around the magnetic stirrer. The cell lysis beads can be any particle-like or bead-like material that has a hardness greater than the hardness of the cells to be lysed. The cell lysis beads may be made of plastic, glass, ceramics, or any other non-magnetic materials, such as non-magnetic metal beads. In certain embodiments, the cell lysis beads are rotationally symmetric to one axis (e.g., spherical, rounded, oval, elliptic, egg-shaped, and droplet-shaped particles). In other embodiments, the cell lysis beads have polyhedron shapes. In other embodiments, the cell lysis beads are irregular shaped particles. In yet other embodiments, the cell lysis beads are particles with protrusions. The magnetic stirrer can be a bar-shaped, cross-shaped, V-shaped, triangular, rectangular, rod or disc-shaped stir element, among others. In some embodiments, the magnetic stirring element has a rectangular shape. In some embodiments, the magnetic stirrer has a two-pronged tuning fork shape. In some embodiments, the magnetic stirrer has a V-like shape. In some embodiments, the magnetic stirrer has a trapezoidal shape. In certain embodiments, the longest dimension of the stir element is slightly smaller than the diameter of the container (e.g. about 75-95% of the diameter of the container). In certain embodiments, the magnetic stirrer is coated with a chemically inert material, such as polymer, glass, or ceramic (e.g., porcelain). In certain embodiments, the polymer is a biocompatible polymer such as PTFE and parylene. A more detailed description of the magnetic lysis method is described in application Ser. No. 12/886,201, which is hereby incorporate by reference.

In some embodiments, the sample processing module 110 comprises a disposable cassette that comprises (1) a plurality of containers, each having an open top end and a closed bottom end; (2) a flow strip comprising a plurality of ports that interact with the sample analysis device via one or more fluid communication devices to establish fluid communication between the cassette and the sample analysis device; and (3) a plurality of reaction chambers, each reaction chamber is connected to a port on the flow strip. At least one of the reagent containers is pre-packaged with a reagent needed for a sample analysis procedure and is sealed with a pierceable cover at the top end of the container. In some embodiments, the cassette comprises a combination of one or more containers with a lyopholized reagent prepackaged therein and one or more containers with a liquid reagent prepackaged therein. In some embodiments, the cassette further comprises one or more containers with a plurality of cell lysis beads and a magnetic stirrer pre-packaged therein. In other embodiments, the cassette further comprises one or more containers with an absorbent prepackaged therein.

As used herein, the term "fluid communication device," refers to any device or component of the system that is capable of establishing a fluid connection between two locations. Examples of fluid communication device include, but are not limited to, tubes, tubings, columns, channels, pipette tips and combinations thereof.

In some other embodiments, the flow strip further comprised one or more pin valves to control fluid flow within the flow strip, e.g., from a reaction chamber to a waste chamber.

In other embodiments, the disposable cassette further comprises one or more sample purification devices. In one embodiment, the one or more sample purification devices, such as TruTips, are used as the fluid communication devices to establish fluid communication between the cassette and the sample analysis device.

As used herein, the term "sample purification device," refers to any devices capable of purifying, isolating or enriching a target molecule. Examples of sample purification device include, but are not limited to, filters, affinity filters, affinity columns, chromatograph columns, and filter tips such as TruTips. In one embodiment, the sample purification device is a pipette tip comprising a monolith filter that binds specifically to nucleic acids.

In other embodiments, each port in the disposable cassette contains a connector for establishing fluid communication with a fluid communication device. Such a connector may comprise a pierceable septum or a dome valve.

In another embodiment, the flow strip further comprises an absorbent that absorbs waste reagents from reaction chambers. In one embodiment, the absorbent is in fluid communication with one or more reaction chambers via one or more pin valves. The absorbent can be any material capable of retention of a large quantity of liquid. In one embodiment, the absorbent is made of an aggregate of fibers. In another embodiment, the absorbent is a nonwoven fabric produced in a through-air bonding process. The constituent fibers of the nonwoven fabric can be hydrophilic synthetic fibers, natural cellulose fibers of pulp or the like, or regenerated cellulose fibers. The fibers may be coated or infiltrated with a surfactant or a hydrophilic oil to improve liquid absorbance. Not limited to the through-air bonding process, the nonwoven fabric for use herein may be produced in any other process such as a spun-bonding process, an air laying process, a spun-lacing process, etc. In another embodiments, the absorbent is a cellulose paper.

In another embodiments, the disposable cassette further comprises a mixing tower connected to the flow strip via one of the plurality of ports.

In some embodiments, the plurality of containers are arranged in the form of a 96-well plate. The plate may contain one or more containers having a lyopholized reagent pre-packaged therein, one or more containers having a liquid reagent pre-packaged therein, and optionally, one or more containers having an absorbent pre-packaged therein. The plate may further comprise one or more containers pre-packaged with a plurality of lysis beads and a magnetic stirrer. The volume of the wells may vary depending on the amounts of the reagents needed. The wells may have the same volume or different volumes. In certain embodiments, the wells have volumes in the ranges of 50 μL, to 5000 μL, 50 μL to 500 μL, 500 μL to 2500 μL, and 1000 μL, to 5000 μL. In one The disposable cassette is connected to the sample analysis system 100 via one or more fluid communication devices and a flow-control manifold on the sample analysis system 100. The flow control manifold comprises a manifold body, a plurality of fluid supply ports that are formed on the manifold body and are adapted to be connected to a fluid supply device, a plurality of plunger channels formed within the manifold body, and a plurality of plungers that are movable along the length of the plunger channels. Each plunder channel has a plunger channel inlet at one end and a plunger channel outlet at another end. Each plunger comprises a seal that seals against the interior wall of the plunger channel in which the plunger is located. The plungers enter the plunger channels from the plunger channel inlets. Each of the plurality of fluid supply ports is connected to a plunger channel and is located in the proximity of the plunger channel inlet of the plunger channel. The plunger channel outlets contain adaptors that connect to a one or more sample purification devices, such as TruTips.

In some embodiments, the flow control manifold further comprises a channel selector for directing fluid flow to a desired fluid control channel through a fluid supply port. In one embodiment, the channel selector comprises a rotary valve. In another embodiment, the channel selector comprises a selector channel having a plurality of outlet ports and a linear motion actuator. The plurality of outlet ports connect to a corresponding fluid supply port on the flow-control manifold. The linear motion actuator comprises a motor and an elongated shaft having a proximal end, a distal end, and an enclosed fluid communication channel within the shaft. The fluid communication channel extends from one or more openings at the proximal end of the shaft to one or more openings at the distal end of the shaft. The one or more openings at the proximal end of the shaft are adapted to be connected to a fluid supply device. The one or more openings at the distal end of the shaft are flanked by two seals, such as o-rings. When the shaft extends into the selector channel, the two seals seal against the interior wall of the selector channel and form a fluid communication passage within the selector channel. Fluid communication between the fluid supply device and an outlet port of the channel selector is established when the shaft is placed in the selector channel in such a position that the fluid communication passage is formed between the one or more openings at the distal end of the shaft and the outlet port of the channel selector. In one embodiment, the selector channel has a vent that prevents pressure change in the selector channel when the shaft moves within the selector channel. For example, such a vent would allow the shaft to move forward within the selector channel without experiencing back pressure.

The temperature control module 120 controls the temperature during the amplification or binding reactions. In certain embodiments, the temperature control module comprises a device with a flexible temperature control surface, as described in U.S. Pat. Nos. 7,955,840 and 7,955,841, both of which are hereby incorporated by reference in their entirety. In certain embodiments, the device comprises a first heater for heating a temperature-control substance to a first temperature; a second heater for heating said temperature-control substance to a second temperature; a pump located in between and connected in series with said first heater and said second heater; and a bladder unit comprising a pair of bladders. Each bladder is coupled to a bladder support and is connected to said first and second heaters via different ports. The pair of bladders are inflatable with the temperature-control substance that controls the temperature of the pair of bladders. The pair of bladders are positioned in a substantially opposing arrangement with a space in between such that both bladders, when inflated, are capable of contacting a reaction chamber placed in the space. During a PCR reaction, the pump introduces the temperature-control substance into the pair of bladders at the first temperature and the second temperature alternatively with a regular interval to enable the PCR.

In other embodiments, the device comprises a bladder assembly comprising: a first temperature-control bladder configured to receive a temperature-control fluid from a first inlet channel and expel the temperature-control fluid from a first outlet channel, a second temperature-control bladder configured to receive the temperature-control fluid from a second inlet channel and expel the temperature-control fluid from a second outlet channel, a first heat exchanger that maintains the temperature-control fluid at a first temperature and is connected to both the first and second inlet channels via a first two-way valve and a first three-way connector, a second heat exchanger that maintains the temperature-control fluid at a second temperature and is connected to both the first and second inlet channels via the first two-way valve and the first three-way connector, and a pump located between the bladder assembly and the heat exchangers. The pump is connected to the first and second outlet channels via a three-way connector and is connected to either the first heat exchanger or the second heat exchanger via a second two-way valve. The first and second temperature-control bladder each comprises a flexible, heat conductive surface that comes in contact with at least a portion of an exterior surface of a reaction chamber after receiving the temperature-control fluid.

The detection module 130 detects the presence of a reaction product. In certain embodiments, the detection module 130 comprises an optical subsystem designed to capture images of the microarray in the reaction chamber. In certain embodiments, the optical subsystem is specifically designed for low-level fluorescence detection on microarrays. The optical subsystem uses confocal or quasi-confocal laser scanners that acquire the microarray image pixel by pixel in the process of interrogating the object plane with a tightly focused laser beam. The laser scanners offer the advantages of spatially uniform sensitivity, wide dynamic range, and efficient rejection of the out-of-focus stray light.

In other embodiments, the optical subsystem uses imaging devices with flood illumination, in which all the microarray elements (features) are illuminated simultaneously, and a multi-element light detector, such as a CCD camera, acquires the image of microarray either all at once or in a sequence of a few partial frames that are subsequently stitched together. Compared to laser scanners, CCD-based imaging devices have simpler designs and lower cost. CCD-based imaging systems are an attractive option for both stand-alone and built-in readers in cost-sensitive applications relying on microarrays of moderate complexity (i.e., having a few hundred or fewer array elements). Commercial instruments typically use cooled CCD cameras and employ expensive custom-designed objective lenses with an enhanced light-collection capability that helps to balance, to some extent, the low efficiency of the excitation scheme.

In other embodiments, the optical subsystem contains an imaging device that uses a non-cooled CCD camera. Although non-cooled cameras typically have a noticeably higher dark current as compared to the cooled models, the optical subsystem could provide the required sensitivity without using exposures in excess of a few seconds by (1) increasing the excitation intensity, or (2) employing an objective lens with high light collection efficiency; or (3) using the above two approaches in combination. The light source can be a conventional light source, such as a metal halide or mercury bulb, a laser-based system, or a high-intensity LED.

In some embodiments, an integrated sample analysis system comprises: (1) a sample preparation/analysis module comprising a sample purification device having a monolith that binds specifically to nucleic acids; and a sample analysis device comprising a microarray enclosed in a reaction chamber having a hydrophilic interior surface; (2) a temperature control module comprising a thermocycler having a thermally conductive temperature-control bladder that, upon receiving a temperature-control substance, expands to abut an exterior surface of the reaction chamber to enable thermal exchange between the temperature-control substance and the internal volume of the reaction chamber; and (3) an imaging device capable of capturing an image of the microarray in the reaction chamber. In one embodiment, the sample analysis/preparation module further comprises a cell lysis chamber containing a plurality of cell lysis beads and a magnetic stirrer.

EXAMPLES

Example 1

Prototype Sample Analysis System

A sample-to-answer sample analysis system is developed by integrating the following technologies: magnetic lysing, TruTip purification, bladder thermocycling, PCR-Microarray Biochip amplification, LED microarray illumination, and gel element microarray imaging into a point-of-care molecular instrument with a disposable cassette.

The magnetic lysing technology involves an external rotating magnet that vigorously mixes and homogenizes tissue/cells in a sample solution with beads using a miniature rotating magnetic stir bar that is placed in close proximity to the external magnet. This approach has the virtue of not requiring a mechanical or electrical interface to the consumable device. Using this method at a 1:1 ratio of sample to beads in a total volume of 1 mL, lysis of 10.sup.4 cfu/mL of gram positive *S. pyogenese* was achieved in 30 seconds in a tube, located several cm from the external magnet. This approach resulted in a 2.5 cycle improvement compared with bead vortexing when analyzed by qPCR.

The TruTip™ nucleic acid purification device (see FIG. 2) consists of a porous monolith. The monolith is a rigid and thick glass matrix, which enables easy insertion into a pipette tip with a low manufacturing burden in a form factor that is easily amenable for automating extraction protocols. The protocol, which can require as few as 4 min, consists of pipetting back and forth through the monolith to bind, wash, air dry, and elute. Cycling back and forth across the porous monolith improves recovery. The monolith is designed to have a large porosity to reduce the back pressure across the monolith when processing viscous samples such as nasopharangeal aspirate (NPA). Nucleic acid purification of M.TB, Vaccinia, VEE, *B. anthracis, Y. pestis*, Influenza A/B, *S. pyogenes, C. pneumoniae*, and MRSA has been demonstrated on sample types such as NPA, Nasopharyngeal swabs (NPS), blood, soil, sputum and urine. Comparisons of the qPCR results obtained using TruTip operated by a Rainin Electronic Pipettor and a standard Qiagen kit indicated that both methods exhibited the same efficiency and recovery in an extensive study. The TruTip, however, was 5× faster, accommodated a larger sample volume, and did not require centrifugation.

A study was performed on the TruTip-epMotion system using FluA (H3N2) and FluB spiked into five different Flu-Negative NPA samples, obtained from Wadsworth Center, State of NY Dept of Health, with varying viscosity (low to high mucus content). FluA was reproducibly detected (100%) at 10 gc μL.sup.−1. FluB was reproducibly detected (100%) at 10.sup.2 gc μL.sup.−1, with 10 gc μL.sup.−1 approaching the detection limit of the real time RT-PCR assay.

The purified nucleic acids were then loaded into the microarray chamber of a PCR-microarray biochip. The PCR-microarray biochip designs allow PCR amplification in the microarray chamber. The biochip may also have a waste chamber to allow washing while maintaining a closed amplicon system. The waste chamber and the microarray chamber are separated by a microfluidic stop or a pin valve, which confines the reaction mix to the microarray chamber during thermocycling. Unlike others, the method of the present invention does not require special hydrophobic coatings or treatments. Rather, it has been demonstrated that a design based on geometry and materials can confine the liquid reagents in the microarray chamber until an additional reagent such as a wash solution is added.

The PCR-Microarray Biochips, described above, can be used for on-chip PCR and post-hybridization washing. The PCR-Microarray Biochip may include a fluidic channel layer in double-sided tape, and the use of a hydrophilic cover film to allow uniform and predictable biochip filling. These biochips may include a pierceable check valve (e.g., Minivalve DS052). This component will ensure a closed amplicon device. Alternatives include the addition of a backseal (permit liquid to flow through the check valve without piercing it) and the use of luer-activated valves (only permit flow when engaged). Plastic pin valves that use 2.4 mm o-rings are an alternative or additional approach to the "valve-less" strategy in which the reaction chamber is isolated from the waste chamber. These valves withstand thermocyling and are low-cost to manufacture.

Liquids flow unidirectionally into but not out of the disposable PCR-Microarray Biochip as a means of ensuring a closed amplicon workflow. In some embodiments, a mixing chamber is included to keep the workflow for reactions such as Allele Specific Primer Extension (APEX). In one embodiment, the mixing chamber is an extended pin valve, so that following PCR, APEX buffer and enzymes could be added to the PCR-Microarray Biochip while simultaneously allowing the pin valve to move up the column, creating space for the mixture. In this example the downstream valve would be closed, and the check valve at the inlet would prevent liquid from exiting the biochip. Air could also be introduced to further enhance mixing, or movement of the pin valve back and forth could assist in mixing.

The microarray consists of gel elements, which have a sterically-favorable spacing of immobilized molecules throughout an aqueous volume of a hemispherical porous hydrophilic polymer. Probes are suspended in a pre-polymer solution, patterned on a surface, and co-polymerized by photopolymerization to create a "gel drop" array. Probes are therefore immobilized to the substrate. The net result of this polymeric structure is increased hybridization kinetics, higher probe immobilization capacity, and up to 100-fold increased detection sensitivity compared with surface-immobilized 2D planar arrays. These features enable low-cost optical instrumentation, rapid hybridization, and the ability to do attachment chemistry in a bulk polymeric phase, which reduces the manufacturing burden, and thus cost per device. Additionally, the co-polymerization methodology can be implemented on native plastics, which eliminates the need for high-priced glass substrates.

The PCR reaction was performed using a specially designed bladder thermal cycling device in which thermally-controlled recirculating flow expands a bladder pair to make intimate contact with the PCR-microarray biochips. As a demonstration of implementing the bladder thermal cycler with coupled PCR and microarray hybridization, one ng of *S. pyogenes* genomic DNA was mixed with PCR master mix and loaded into two PCR-microarray biochips. The thermal cycling protocol took less than 26 minutes (44 cycles of 5 sec at 85° C. and 30 sec at 50° C.), and hybridization was less than 15 minutes, compared to 3 to 4 hours on a conventional slide block thermal cycler. Despite the use of a thick (1 mm) glass substrate, rapid PCR amplification was achieved for the following 3 reasons:

(1) Fast ramp times (.about.10° C./s), as opposed to prolonged cooling of a large metal block, was possible by the use of fluidic switching.

(2) Tight intimate contact of the bladder pair with the biochip substrates resulted in high thermal conductivity. Poor contact between the heater and the reaction vessel with conventional methods is typically responsible for substantial thermal inefficiencies.

(3) The recirculating flow convectively heats and cools the reaction chamber. Convection is typically the most effective heat transfer mode.

The amplified signals are detected by an imaging device, which consists of a single LED and a non-cooled CCD camera.

Figure 3:
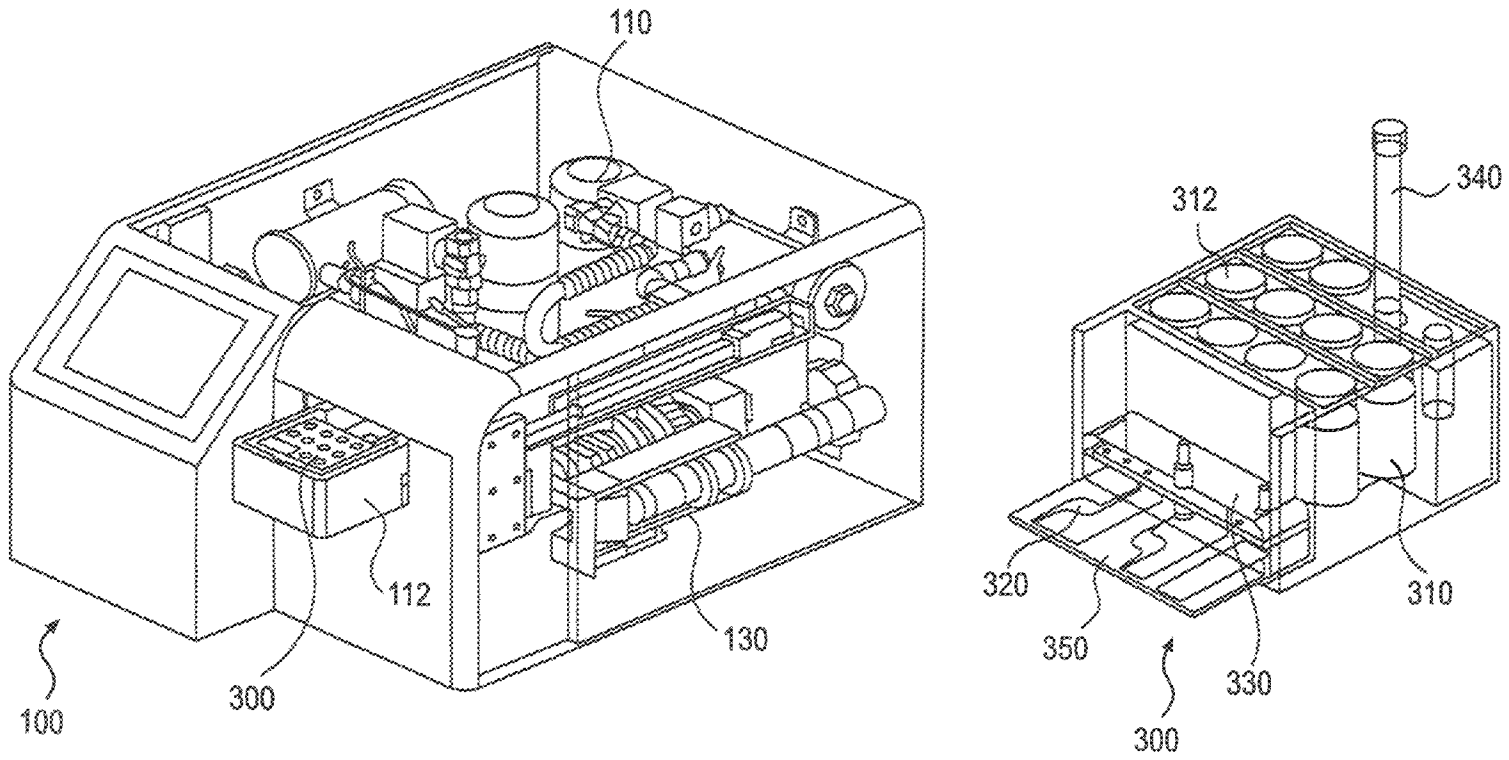
FIG. 3 shows an embodiment of a complete sample detection system with the disposable cassette.
Figure 4:
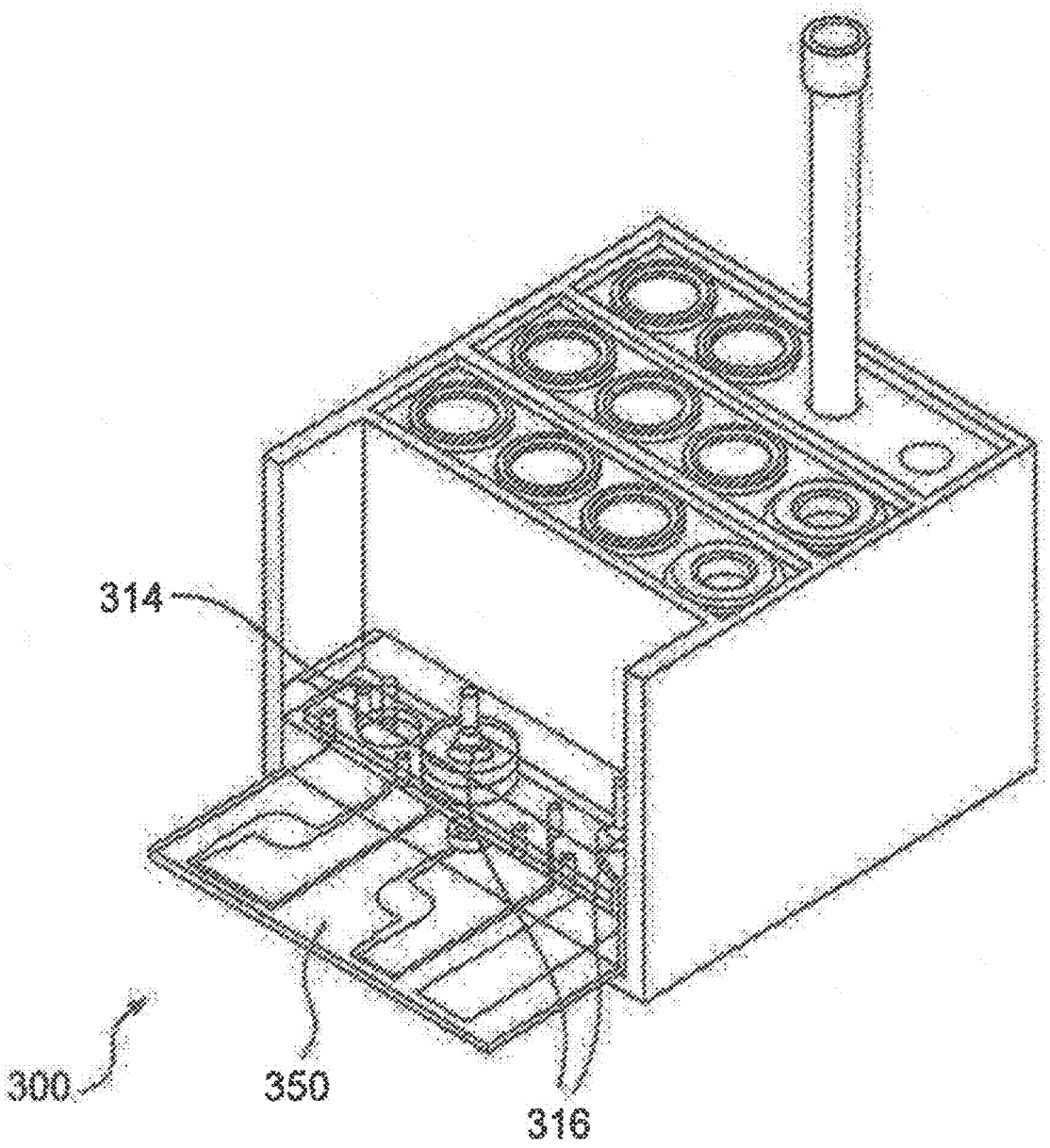
FIG. 4 shows another embodiment of the disposable cassette of the present invention.

Pre-packaged reagents for molecular diagnostics instruments reduces the complexity of the device. Thus, Akonni has developed a disposable cassette 300 that can be inserted into the sample analysis system 100 through a retractable carriage 112 (FIG. 3). The cassette 300 comprises a strip of pierceable reagent container 310, one or more reaction chambers 320, and a flow strip 330 that controls fluid flow from a sample purification device 340, such as a TruTip, to the reaction chambers 320. The reaction chambers 320 may be formed within a PCR microarray biochip 350. The reagents may contain reagents for lysis, purification and PCR amplification. The lids 312 of the tubes are made of pierceable foil that could be attached with heat sealing, an adhesive, or crimping a metal cover around a glass or plastic vial. The foil may also be attached to a plastic tube such as a PCR tube. The cassette 300 allows ease of packaging lyophilized reagents with sufficient moisture barriers to protect them from liquid reagents. A pipette tip can pierce the foil and remove the reagents from the tube and transport nucleic acid and/or liquids from one tube to another. In this embodiment, the flow strip cassette includes a disposable TruTip 340 that engages a pipette head on the instrument for the purification protocol, reagent rehydration, and PCR-microarray biochip filling. In one embodiment, only nucleic acid, adsorbed to the monolith, is transported from one tube to the next, thus liquids remain in their respective tubes, reducing the risk of sample contamination. Rehydrated mastermix with purified sample is then introduced via the TruTip into the PCR-microarray biochip, which is subsequently inserted between a bladder pair for thermocycling. A pierceable check valve confines the amplicon to a closed system, but allows a wash solution to flow across the array for subsequent imaging. In other embodiments, the TruTip 340 is designed to contain a filter that binds specifically to a target molecule of interest, such as a protein, a peptide, a DNA, an RNA or other biomolecules. FIG. 4 shows a cassette 300 with a sample port 314 and pin valves 316 that control the fluid flow within the biochip 350.

Figure 5:
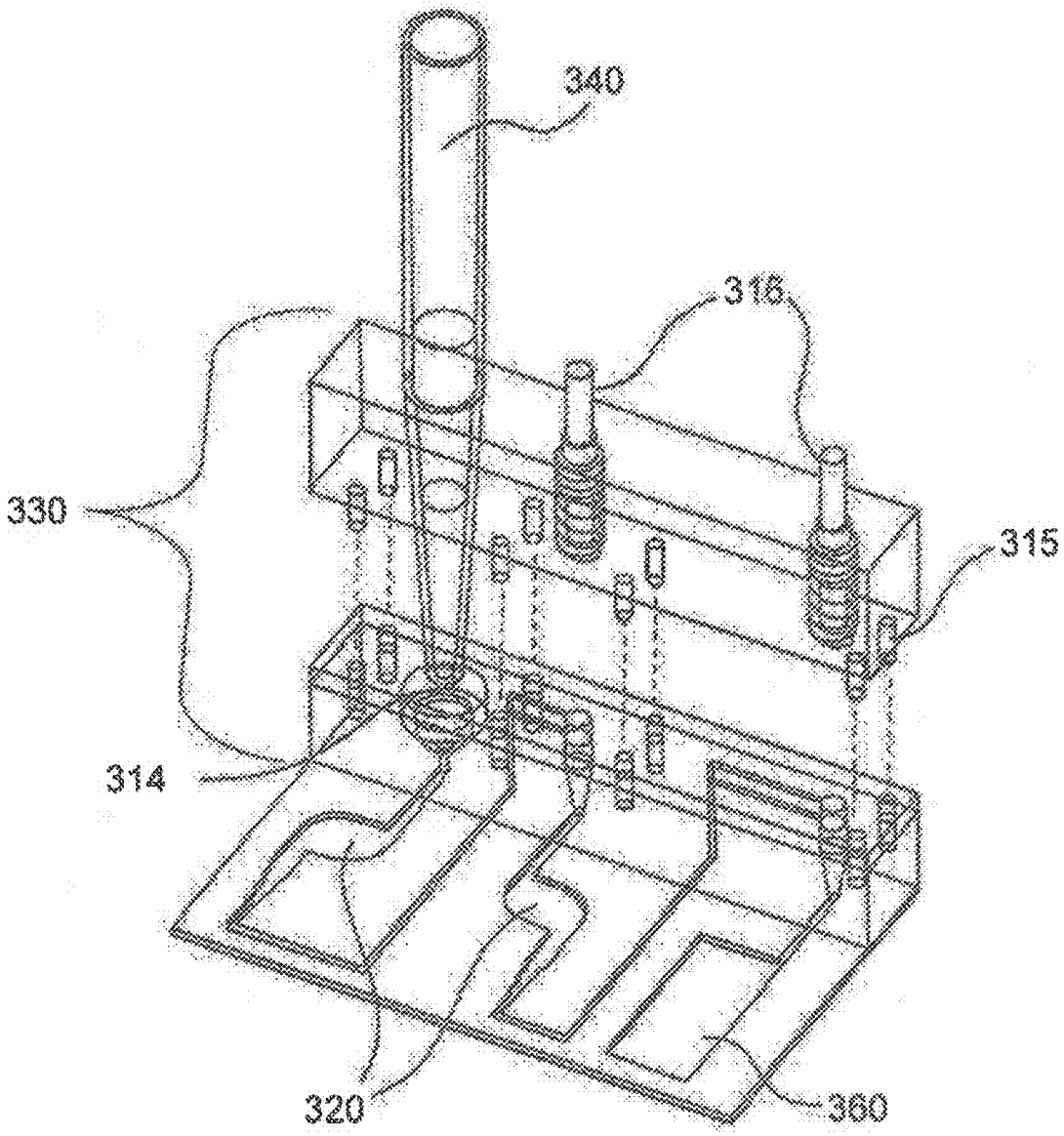
FIG. 5 shows a three-dimensional view of the flow strip portion of a flow strip cassette.

FIG. 5 shows the flow strip 330 portion of a cassette 300. In this embodiment, the flow strip 330 comprises a sample port 314 to receive the TruTip 340, and pin valves 316 that control the liquid flow from reaction chambers 320 to waste chamber 360. In some other embodiment, the flow strip 330 further comprises one or more magnetic lysing or mixing towers (not shown)

The containers 310 in the cassette 300 can be plastic tubes, glass vials or wells in a plate (e.g., 96 deep-well plate). Miniature linear actuators with an integrated positional-feedback potentiometer may be used for repeatedly dispensing and withdrawing from the bottom of 2 mL tubes (11 mm diameter) and glass lyophilization vials. In one embodiment, the monolith is placed towards the top of the pipette tip, increasing the volume below the monolith. This increases the volume that does not make contact with the monolith, which may be useful for pipetting reagents such as the PCR buffer into the flow strip. Contact of the PCR buffer with the monolith may introduce unwanted air into the PCR buffer, causing bubbles. With this embodiment a single pipette tip could be used for all steps. Another embodiment is to use multiple tips for multiple pipetting steps. In one embodiment, disposable pierceable check valves (e.g., Minivalve) are press-fit under a screw cap with an access hole as a means of introducing sample and providing access for the TruTip without releasing aerosols during magnetic rotation. Hydrophobic-coated lysing beads are a means to minimize DNA adsorption, and thus eliminate the need for a sample transfer step to a separate chaotrophe tube. Alternative TruTip designs include various porosity sizes (1 to 100 micron), different thickness (0.1 to 10 mm), stacks of different porosity monoliths (1 to 10), single monolith with sections of different porosities and/or conventional approaches (e.g., bead vortexing, stepper motors, multiple pipette tips). To reduce the PCR multiplexing complexity, multiple chambers may be used to split the PCR Mastermix/sample reagents into multiple reservoirs. This may be useful for simultaneous sample processing of both bacteria and viruses.

Example 2

Multiway Selector Design

This example will consider the testing and design process of a device used to select between eight different ports on an eight-port manifold, allowing air to flow through only a single port at a time. This device is referred to as an eight-way selector, which is used to dry pipette tips on an automated liquid handling system. This system uses eight pipette tips to simultaneously complete eight separate sample preparations. In one embodiment, an eight-way selector is designed in order to allow airflow from a common air source to dry a matrix within these pipette tips.

A. Testing on Flow Rate

Figure 6:
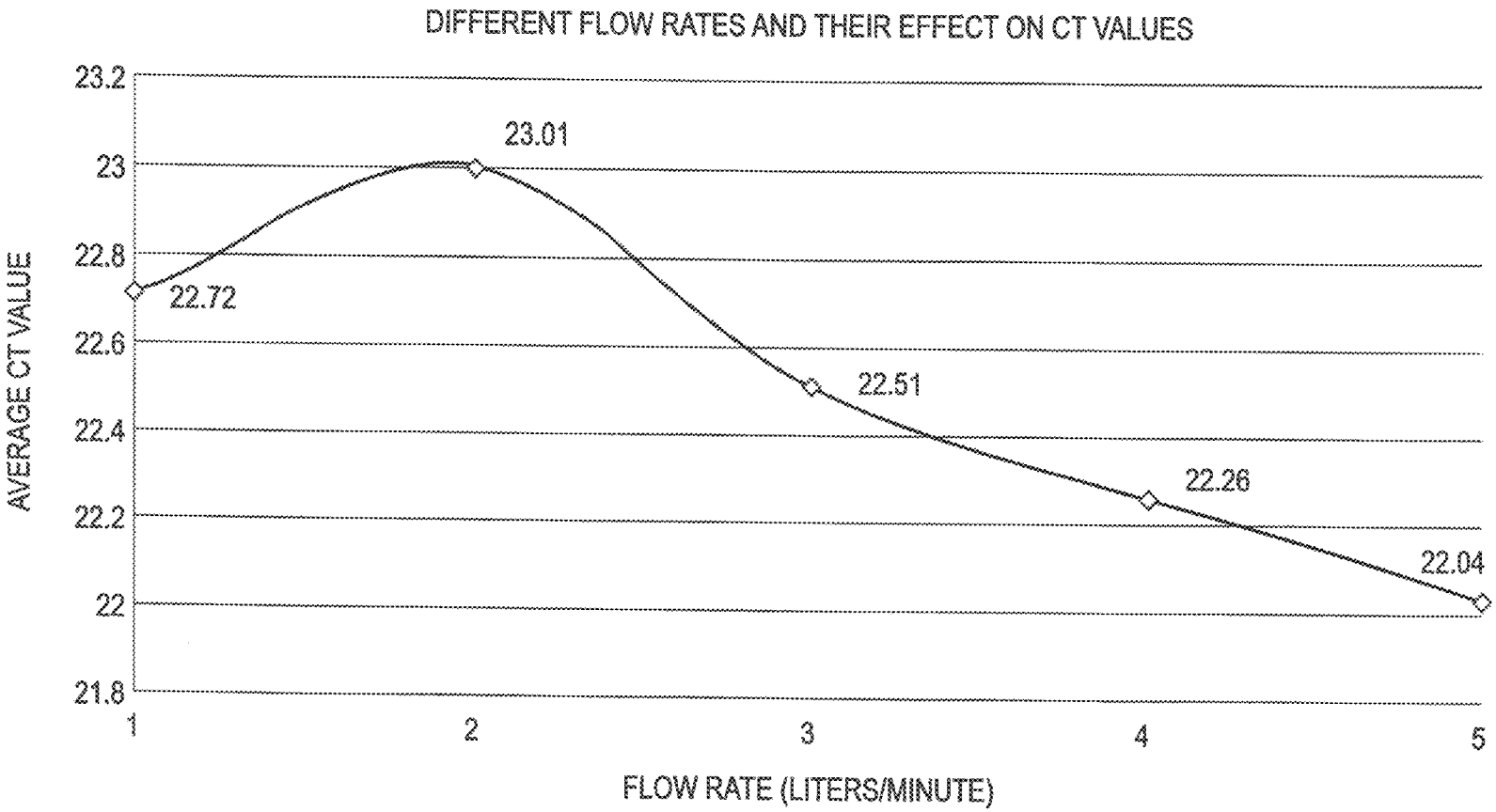
FIG. 6 shows the effect of air flow rates on the CT values of DNA amplification.

Prior to integration of the 8-way selector to the 8-port manifold, testing was conducted to determine the effect of air flow rate on the cross threshold (CT) values during the DNA extraction and amplification processes used. Briefly, the system was connected to a flow meter to measure flow. Five different new flow rates were tested for their effects on the CT values during the DNA extraction and amplification processes. A previously-used manual flow rate was included in the test as the control flow rate, which resulted in a control CT value of around 23.5. As shown in FIG. 6, all the tested flow rates resulted in CT values that are lower than the control CT value. Based on the results of FIG. 6, it appears that 5 liters per minute is the most desirable flow rate for the S-way selector because it resulted in the lowest CT value.

B. Eight-Way Selector Design

Several designs may be used for the eight-way selectors. First, the selective access to each port on the eight-port flow strip may be controlled by an eight-way rotary valve, which is commercially available but expensive.

Figure 7A:
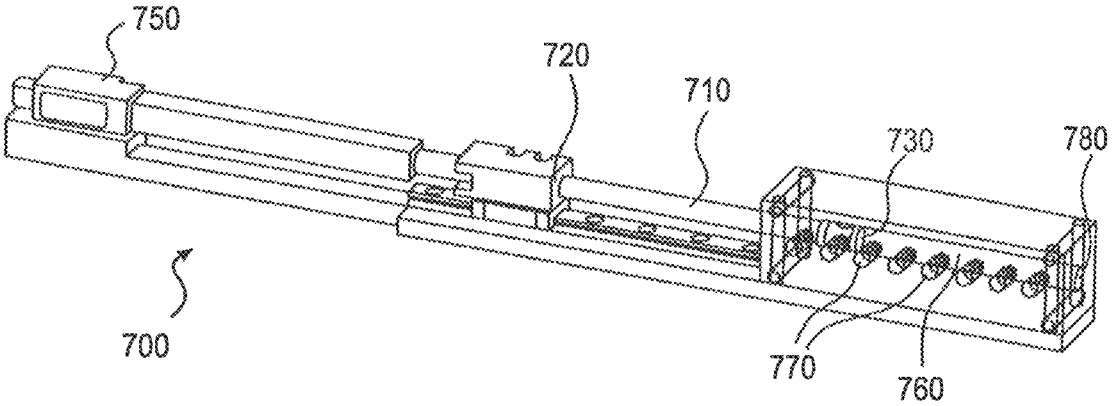
FIG. 7A shows a linear 8-way selector.
Figure 7B:
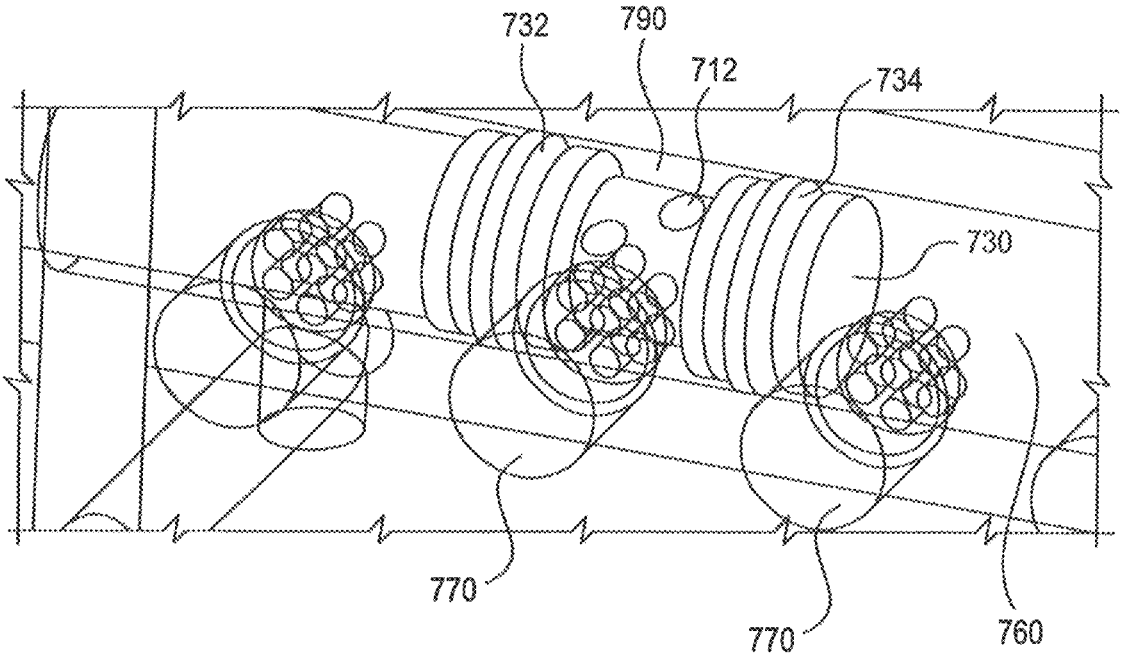
FIG. 7B is a close-up view of the o-ring seal structure at the distal end of the selector plunger.

Alternatively, a linear actuator can be used to control access of air to each of the eight-ports through the TruTips for additional drying or in the flow strip for drying the microarray. As shown in FIGS. 7A and 7B. The linear actuator 700 contains a motor 750 and a shaft 710 having a proximate end 720 and a distal end 730. The shaft 710 comprises two O-rings 732 and 734 at the distal end 730. The shaft 710 has a channel that is connected to an air supply on the proximal end 720 and one or more air outlet 712 at the distal end 730. The air outlet 712 is located between the two O-rings 732 and 734. The shaft 710 travels in a selector channel 760 that is connected to eight outlet ports 770. The selector channel 760 has a vent 780 at the distal end to prevent pressure built-up in the channel. As shown in FIG. 7B, the two O-rings 732 and 734 seal against the interior wall of the selector channel 760 to form a fluid communication passage 790. Air travelling down the hollow length of the shaft 710 and exiting at the air outlet 712 would be trapped between the two O-rings 732 and 734, and could only escape through a single port 770 on the manifold at any time. It is possible, however, to adjust the distance between the two O-rings 732 and 734 so that air may escape through two or more ports 770 at the same time. Similarly, multiple O-rings may be used to form multiple fluid communication passages, thus allowing air flow to multiple ports at the same time.

Figure 8:
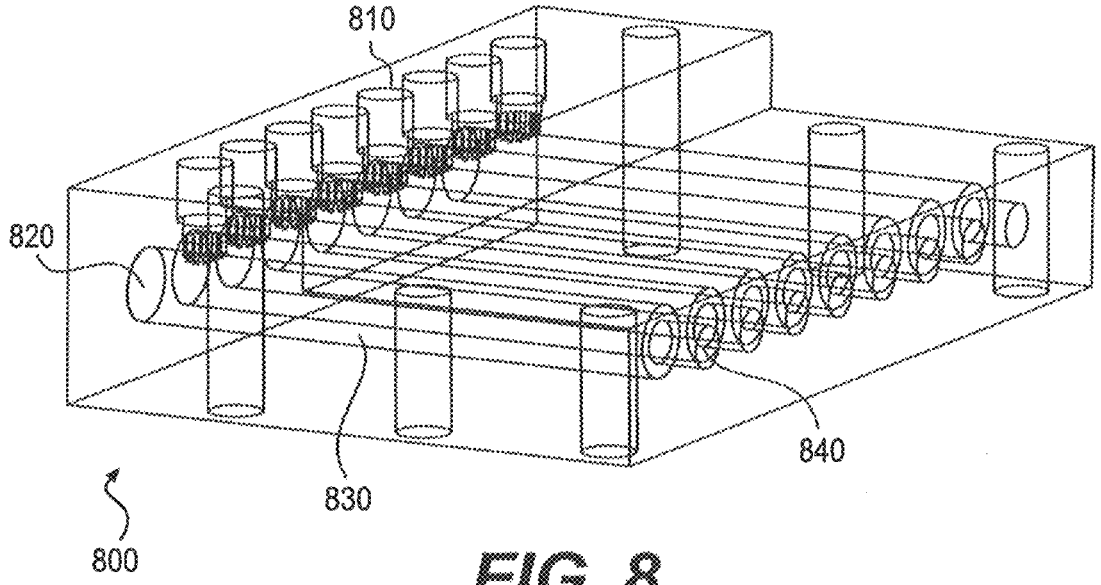
FIG. 8 shows a 8-channel manifold that interacts with the 8-way selector and a 8-sample disposable cassette.

FIG. 8 shows an eight-channel manifold 800 having eight fluid supply ports 810, eight plunger channel inlet 820, eight plunger channels 830 and eight plunger channel outlet ports 840, which connect to pipette tip ports (i.e., TruTip ports) (not shown). The fluid supply ports 810, which connect to the corresponding eight-way selector valve ports 770, are placed towards the end of the plunger channels 830 so as to allow plungers (not shown), which enters the plunger channel 830 through the plunger channel inlet 820, to travel the vast majority of the length without changing the pipette flow dynamics of aspirating and dispensing fluids. When it is time for the air drying step, the plungers can be pulled back so that air can travel from the eight-way selector described in FIGS. 7A and 7B through the fluid supply ports 810 into the plunger channels 830 and out the plunger channel outlet port 840. In one embodiment, only a single plunger channel 830 will be open to airflow at any one time. This air will be forced to flow into the pipette tips, as a plunger in the manifold will be behind the fluid supply port 810, preventing air from escaping out of the plunger channel inlet 820.

Another design is to allow all eight pipette tips to be exposed to the common air source at the same time. This design would eliminate the need for selecting a single port for airflow.

Example 3

Automated Multi-Sample Detection System

Figure 9:
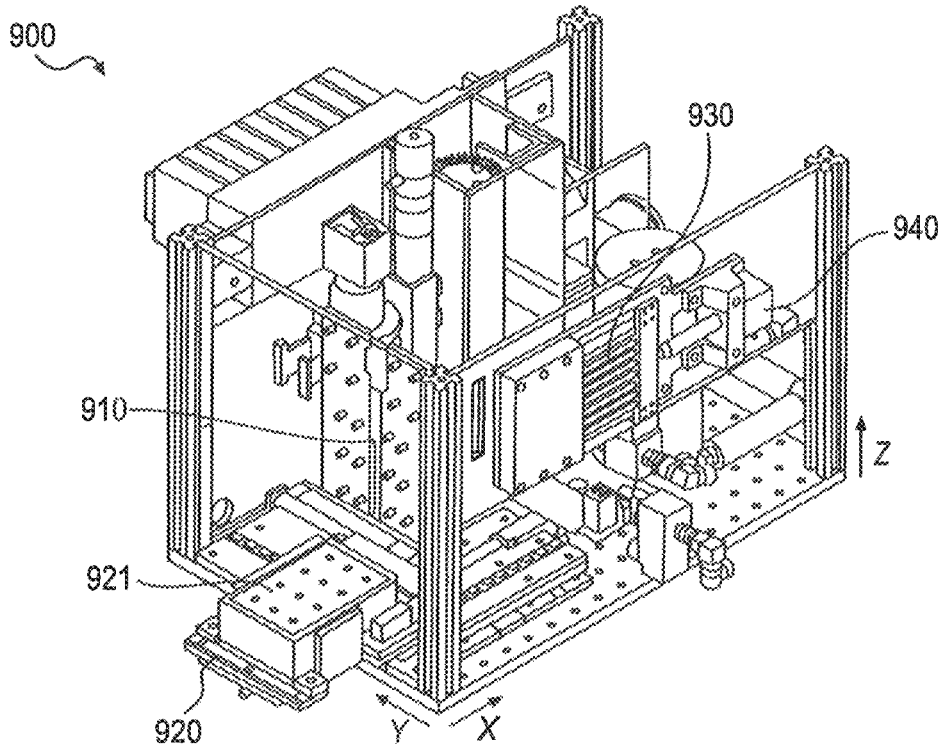
FIG. 9 shows an automated sample analysis system highlighting the components needed for sample extraction.

FIG. 9 shows an automated sample-to-answer system 900 that is able to perform sample extractions, on-slide PCR, and array imaging for eight samples simultaneously.

A. Sample Purification/Extraction

There are three main sub-systems of the system 900 that relate to sample purification and extraction. These sub-systems include tip holder 910, plate holder 920, and plunger system 930. The tip holder 1100 secures the TruTips (not shown) to the system 900 and holds them stationary in the X-Y plane. However, the tip holder 910 is connected to an actuator which allows control of the TruTips in the Z plane. It's also conceivable that the TruTips are moved in all directions (i.e., not stationary). The plate holder 920 secures a 2 mL 96 deep well plate 921 which is used as a reservoir for all reagents and samples needed for an end-to-end run. The plate holder 920 moves the deep well plate 921 in the X-Y plane allowing for the TruTips to move from column to column on the deep well plate 921. Finally, the plunger system 930, which is connected to a stepper motor 940, controls the volume in which the TruTip can aspirate and dispense.

Figure 11:
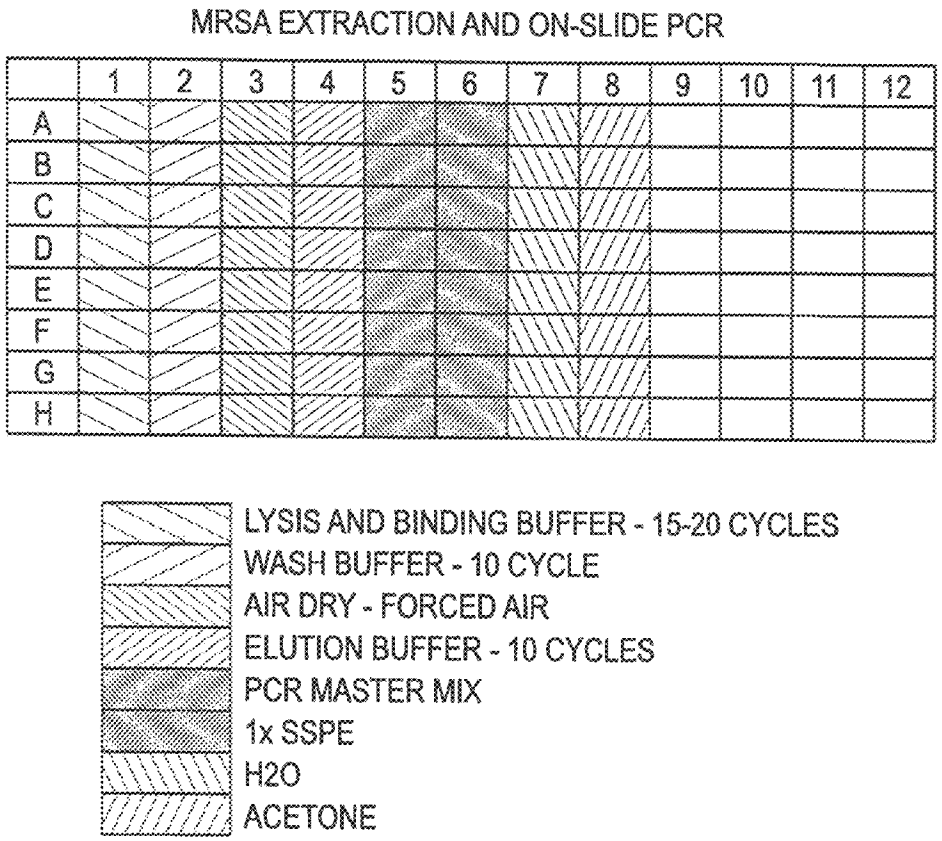
FIG. 11 shows an embodiment of the reagent layout in a 2 mL, 96 deep-well reagent plate for MRSA extraction and on-slide PCR.

Multiple sample extractions have been performed on system 900 using genomic Methicillin-resistant *Staphylococcus aureus* DNA (gMRSA) and live MRSA in two mediums—water and nasal pharyngeal aspirate (NPA). Automated extractions on the system 900 rely on the 2 mL deep-well plates 1201 to contain all necessary reagents, e.g., lysis buffer, wash buffer, and elution buffer (see, e.g., FIG. 11). The TruTips are inserted into each column of the plate 921 and the reagents are toggled through the tips for sample purification and extraction to occur. The first column of the plate contains the sample along with lysis buffer—this mixture (500-1000 μL) flows through the tips for 5-20 cycles depending on the medium in which the sample is in. In one embodiment, 15 cycles are used for samples in water and 20 for samples in NPA. This is then followed by a wash step that requires toggling the wash buffer (500 μL) for 10 cycles. Next, the matrix within the TruTip is air dried and finally the elution step occurs where the elution buffer (504) is toggled through the tips for another 10 cycles—DNA is recovered in this buffer.

Throughout the testing effort it had been determined that incorporating a unidirectional forced air system helps dry the TruTip matrix allowing for better recovery of DNA, even when compared to traditional manual extractions. Air drying follows the wash step and is required to properly dry the matrix—each tip is dried separately for 1 minute. Residual wash buffer can interfere with recovery and inhibit polymerase chain reaction (PCR). A comparison of manual vs. automated extractions of 250 μL of 100 pg/μL gMRSA in H2O showed that the manual extractions average a CT of 23.73 while the automated extractions average 22.38-1.5 cycles lower. The air drying component was applied to all further extractions.

Once testing on genomic MRSA was completed, live whole cells were used. Live MRSA was grown in-house and suspended in saline solution for a final concentration of 0.5 McFarland. An initial lysis step was required for these cells and was performed manually; however, this can be included in the automated system. The lysis was done with a magnetic lysing, described earlier, using 50 grams of Ceroglass 100-200 micron ceramic beads and 250 μL of the live MRSA cells. The cells were lysed at 100% speed for two minutes and then placed into the 1.sup.St column of the 2 mL deep well plate. Cells were also heat killed at 100° C. for 15 minutes prior to use to prevent any possible infection of users. This experiment followed the same protocol as the gMRSA in H.sub.2O and did not require additional ethanol. The average CT was 22.88, which is equivalent to the 100 pg/μL sample that was run as a positive control.

Sample purification was also tested on live MRSA cells spiked in NPA—used to represent a clinical sample. This sample required a manual lysis step to homogenize the NPA and lyse the MRSA cells. For this sample, lysis was performed on 250 μL of 0.5 McFarland MRSA (heat killed) mixed with 250 μL of NPA. Once lysing treatment was complete, the sample was added to the lysis and binding buffer with an additional 250 μL of 95% ethanol (total volume of 1000 μL). The sample was toggled on the sample analysis system through the TruTip for 20 cycles which was then followed by the wash, air dry, and elution steps. Eight samples were extracted on the system 1000 and the real-time results show a CT average of 23.84 which is equivalent to the 100 pg/μL sample that was run as a positive control.

B. On-Slide PCR

All extractions performed on the system 900 were used to complete on-slide PCR using the bladder thermal cycler and obtain sample-to-answer results. The system 900 embodiment has the ability to perform on-slide PCR for eight samples at a time using a microarray and bladder thermal cycler. The bladder thermal cycler has five main components: a hot reservoir, a cold reservoir, a pump, one or more valves, and a bladder or a bladder pair. The basic mechanism behind the bladder thermal cycler is to circulate two different temperatures of liquid through the bladder for rapid thermal cycling. Both the hot and cold reservoir must initially be brought up to temperature before thermal cycling can begin. The pumps force the fluid through the path and rely on selection valves to direct the proper temperature fluid to enter the bladder. The bladder or bladder pair, once filled with liquid, expand around the inserted multi-chamber flow cell encasing it and transferring the proper temperature.

Figure 10:
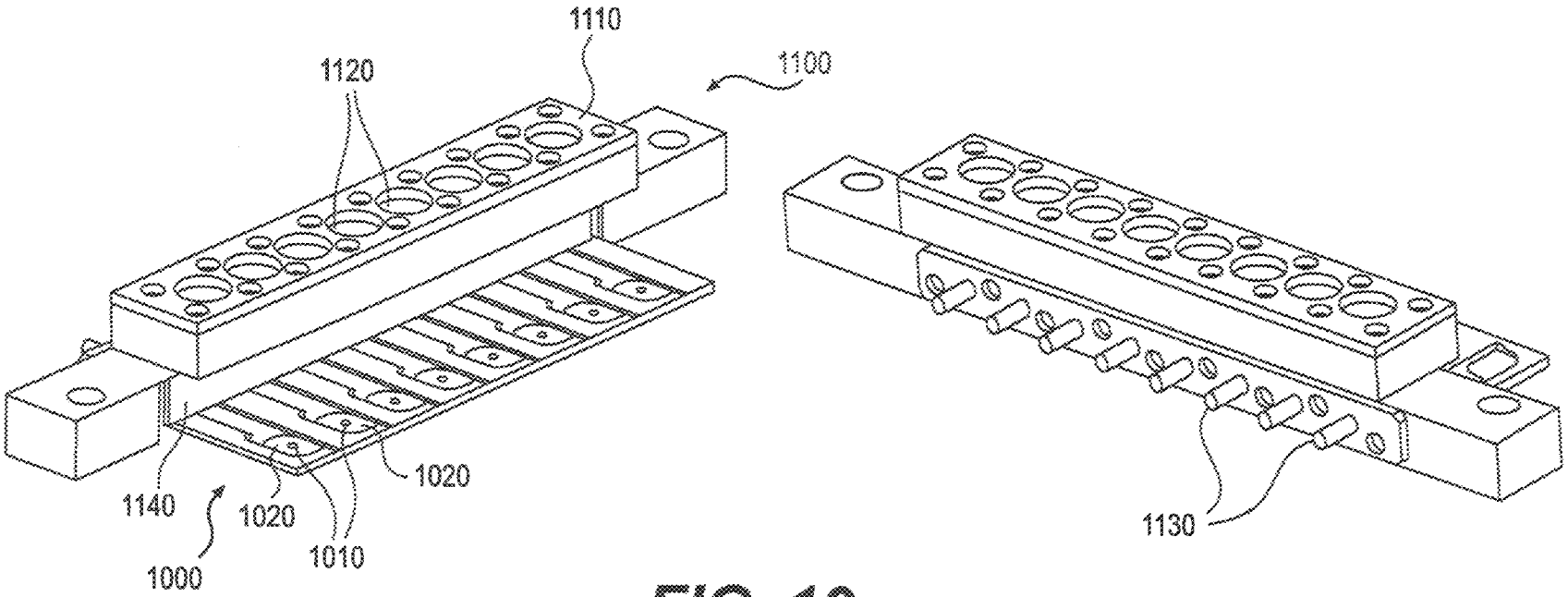
FIG. 10 shows the front and back views of a flow strip with a multi-array flow cell.

As shown in FIG. 10, the multi-chamber flow cell 1000 has eight independent microarrays 1010 that are enclosed in the reaction chambers 1020, which allow the PCR mixture to interact with the array 1010. The multi-chamber flow cell 1000 is secured to a flow strip 1100 by a housing 1110 that encases dome valves 1120, pin valves 1130, and an absorbent 1140. The housing 1110 directs the PCR mixture that is pipetted in from the 2 mL 96 deep well plate to the flow cell 1000 through these dome valves 1120, which also act as a seal during thermal cycling preventing any leakage. The pin valves 1130 are controlled by a linear actuator that enables them to be opened and closed. In an open position, the pin valves 1130 allow liquid flow during the wash steps. In a closed position, the pin valves 1130 help trap the PCR mixture in reaction chamber 1010 of the flow cell 1000 during thermal cycling. The absorbent 1140 attached to the housing 1110 collects all wash buffers once passed through the flow cell 1000.

The on-chip PCR portion of a sample-to-answer test begins with the warm-up of the bladder thermal cycler. This warm-up step is used to bring both the hot and cold reservoir up to the required temperatures of 88° C. and 51° C. respectively. During this warm-up step, the PCR buffer is placed in the same 2 mL 96 deep well plate used during sample extraction. On-chip PCR requires the uses of 4 columns: PCR mastermix, 1×SSPE, Water, and Acetone. FIG. 1 shows the reagent layout of a representative plate. Fifty microliters of the PCR buffer is introduced to all 8 of the housing ports, which is connected to the 8 chamber flow cell, using the automated system. Once all 8 chambers are filled, the pin valves are closed and the flow cell is inserted into the bladder and thermal cycling initiates. The thermal cycling parameters are an initial 88° C. for 2 minutes followed by 40 cycles of 88'C. for 45 seconds and 51° C. for 90 seconds. There is a final cool down step of 51° C. for 5 minutes. Once thermal cycling is complete, the automated system removes the flow strip from the bladder and hybridization occurs at room temperature. Hybridization occurs for 2 hours and then the 3 different washes flow into the flow strip and into the flow cell array chambers at 50 μL aliquots, of 1×SSPE, water and acetone, sequentially. Acetone is an optional reagent for drying the microarray, C. Imaging/Analysis The system 900 has an integrated imaging system that is able to capture the fluorescence of all 8 microarrays individually. The imager is mounted on a moving platform that controls its location on the X-Y plane and has the ability to move in the Z plane for focusing. After the completion of on-chip PCR and washing, the arrays are imaged and analyzed. Analysis was completed using MCI Software and an Akonni MRSA analysis workbook. The MCI software uses a fixed circle method to determine the intensity of each probe present on the array. Each array has 4 identical quadrants (i.e., each probe is present on the array 4 times). Once intensities are determined, the highest and lowest values are removed and the median is taken from the other two probes. This median determines the overall intensity of the probe. In order to determine if the signal is considered positive or negative, two factors are used: the dN20 Ratio and the Sigma Ratio. The dN20 spots, a mixture of random 20 mer nonsense probes included in the microarray, are used to measure "biological noise" due to effects such as poor washing, cross-hybridization, and/or excess DNA in the sample. Its measured intensity is determined the same way as signal spots. The overall intensity of each probe is subsequently divided by the overall intensity of the dN20 signals. If this ratio is above 1 then the signal is considered to be detectable. Sigma is also used to determine if the signal is above threshold. Sigma is the standard deviation of the background (region where spots are not located) in the image. Each probe is divided by three times sigma to calculate the spot signal-to-noise ratio. The ratio to determine whether or not the spot is considered a detection event is to divide by the greater value (dN20 or 3×Sigma ratio). This approach was used for the analysis described.

Figure 12A:
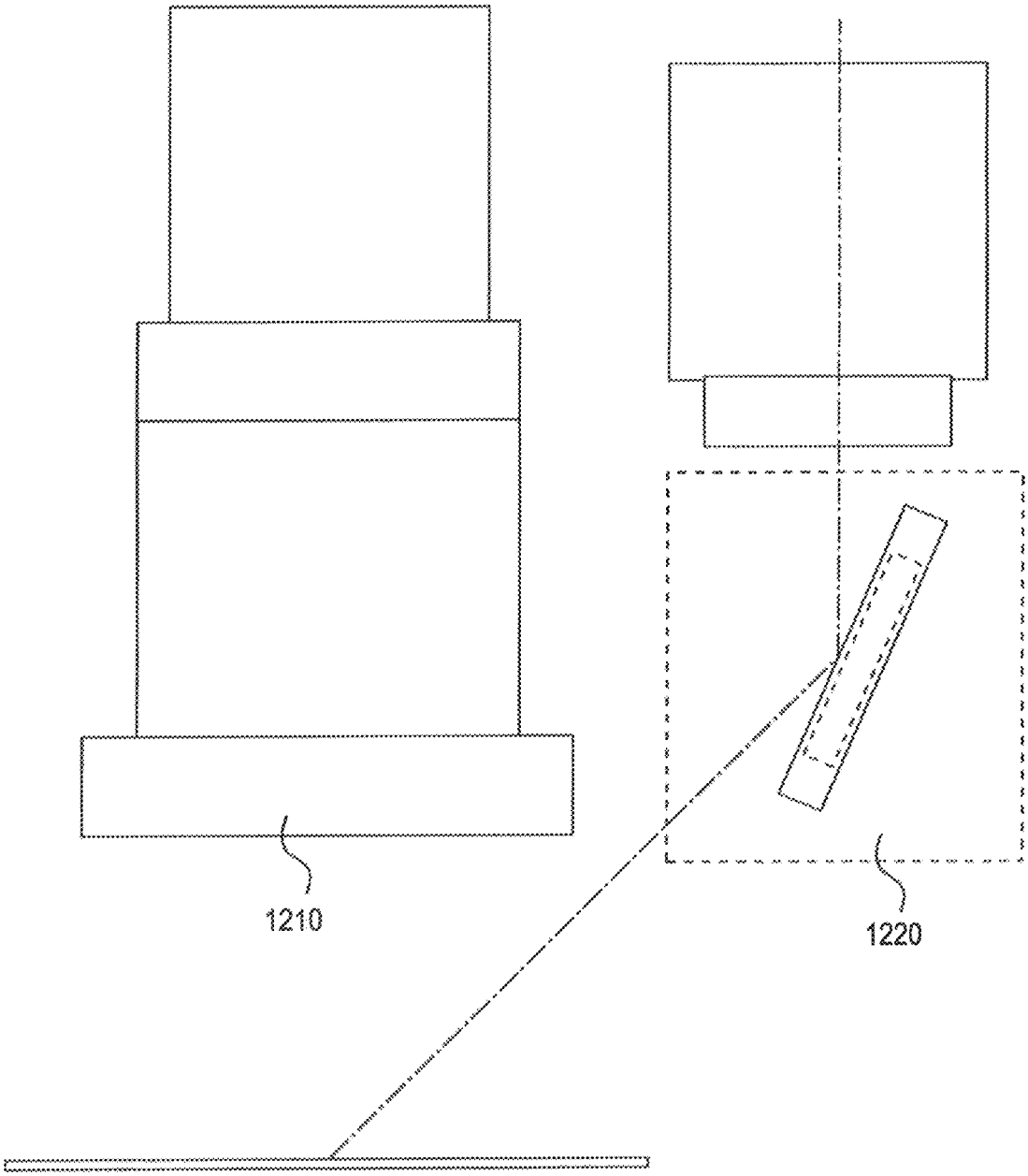
FIGS. 12A-12C show several embodiments of the optic design in the sample analysis system of the present application.
Figure 12B:
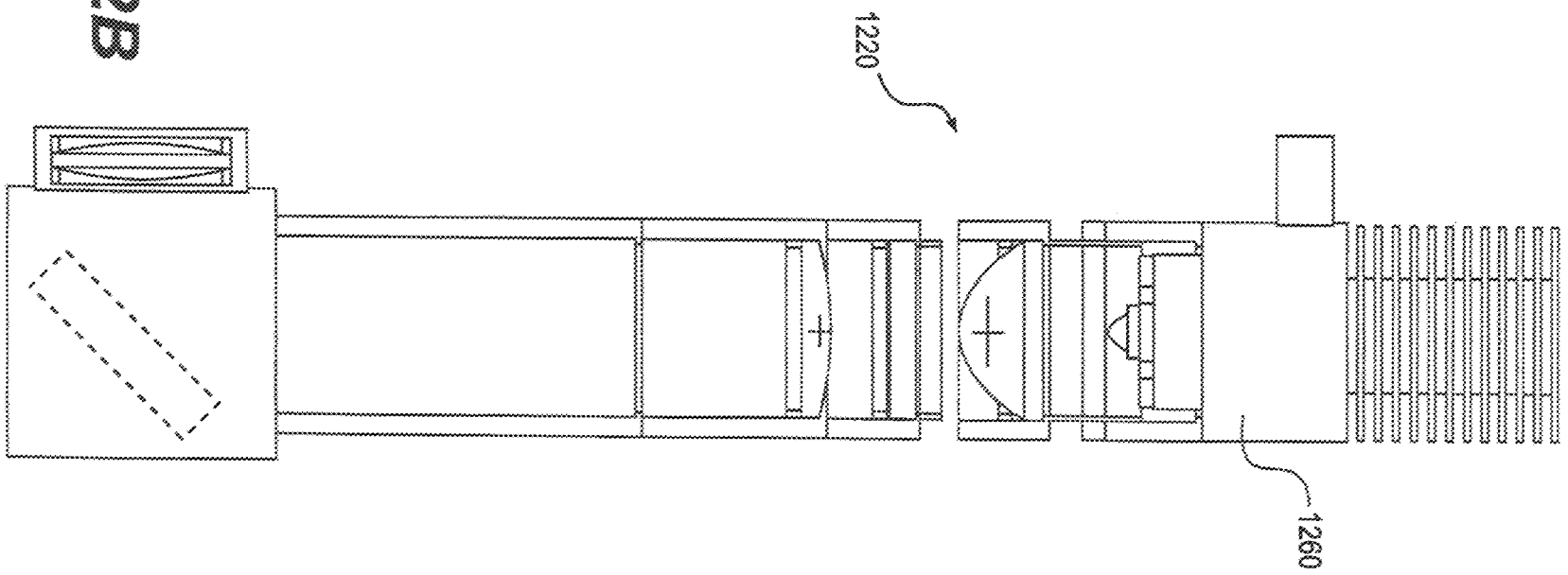
Figure 12C:
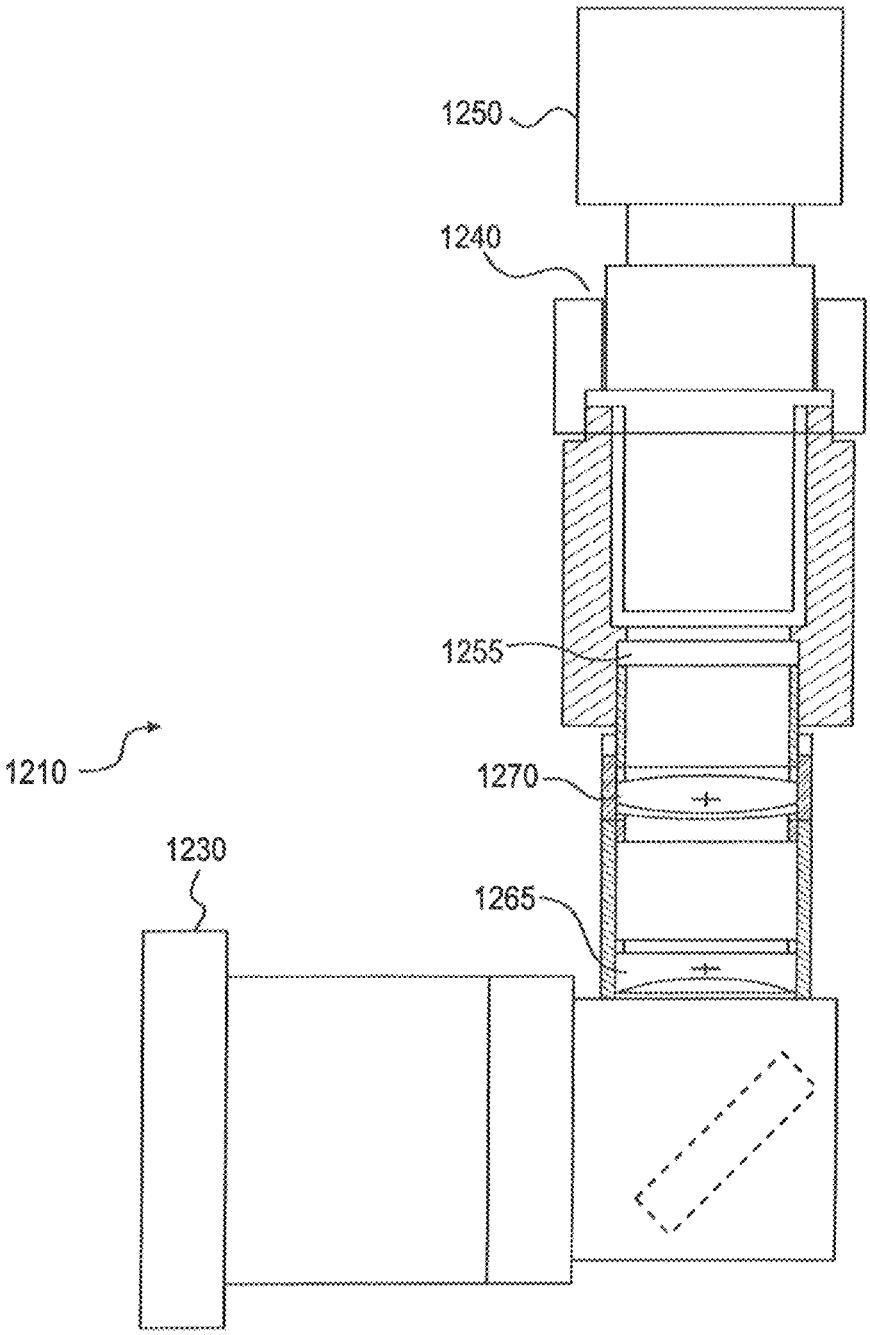

FIGS. 12A-12C show embodiments of oblique angle illumination for microarray imaging schemes. FIG. 12A shows the general concept of oblique angle illumination for microarray imaging. The system's optical train comprises two separate channels 1210 and 1220. Channel 1220 is used for fluorescence excitation and channel 1210 is used for imaging the array. FIG. 12B is an embodiment of the illumination optical train that includes a mirror to divert the illumination source at a 90 degree angle to allow a significant portion of the illumination optics to be parallel to the microarray substrate. FIG. 12C is an embodiment of the collection light optical train that includes a mirror to divert the collection light at a 90 degree angle to allow a significant portion of the detection optics to be parallel to the microarray substrate.

As shown in FIGS. 12B and 12C, the optical train includes high-quality off-the-shelf imaging optics (an objective lens 1230 and a matching video lens 1240) available from Leica Microsystems (Bannockbum, Ill.), a compact low-noise monochrome ⅓" CCD camera 1250 (Allied Vision Technologies Canada Inc., Burnaby, BC), and a 530 nm high-intensity LED (Philips Lumileds Lighting Company, San Jose, Calif.) as a fluorescence excitation source 1260. In contrast to the commonly-used fluorescence microscopy epi-illumination scheme, in which the objective is used for both illuminating and imaging the object, this design eliminates the background due to both the excitation light back scattered in the objective and the possible optics autofluorescence. Also, oblique illumination at a 45° incidence angle helps to direct the major portion of the excitation light reflected from the microarray substrate away from the objective lens. This design is facilitated by the long working distance (39 mm) and a relatively high light collecting efficiency (NA=0.234) of the Planapo 2× objective lens developed by Leica for their high-end line of stereo microscopes. Since the objective is infinity-corrected, the array surface of the slide should be positioned at the front focal plane of the lens. The emission filter 1255 (part #FF01-593/40-25, Semrock, Rochester, N.Y.) is located in the infinity space between the objective and video lens and two-component beam expander comprising a plano-concave lens 1265 and an achromatic doublet 1270 (part ##LC1582-A and AC254-100-A-ML, respectively; Thorlabs, Newton, N.J.). The beam expander (not shown) reduces the magnification factor of the entire lens system to 0.75×. With the current CCD sensor having ⅓" format and a 7.4 μm pixel size, this magnification adjustment allows imaging arrays of up to 12×18 gel elements with a spatial resolution (limited by the CCD array pixel size) of about 10 μm. The fluorescence excitation channel implements the Kohler illumination scheme for a projection system, which ensures uniform (within 3%) illumination of the object plane despite the complex structure of light emitting region of the LED (part #M530L1 available from Thorlabs). The bandpass clean-up filter (part #FF01-525/45-25, Semrock) placed between the collector and condenser lenses cuts off the long-wavelength wing of the LED emission spectrum that overlaps with the fluorescence band of Cy3.

Figure 13:
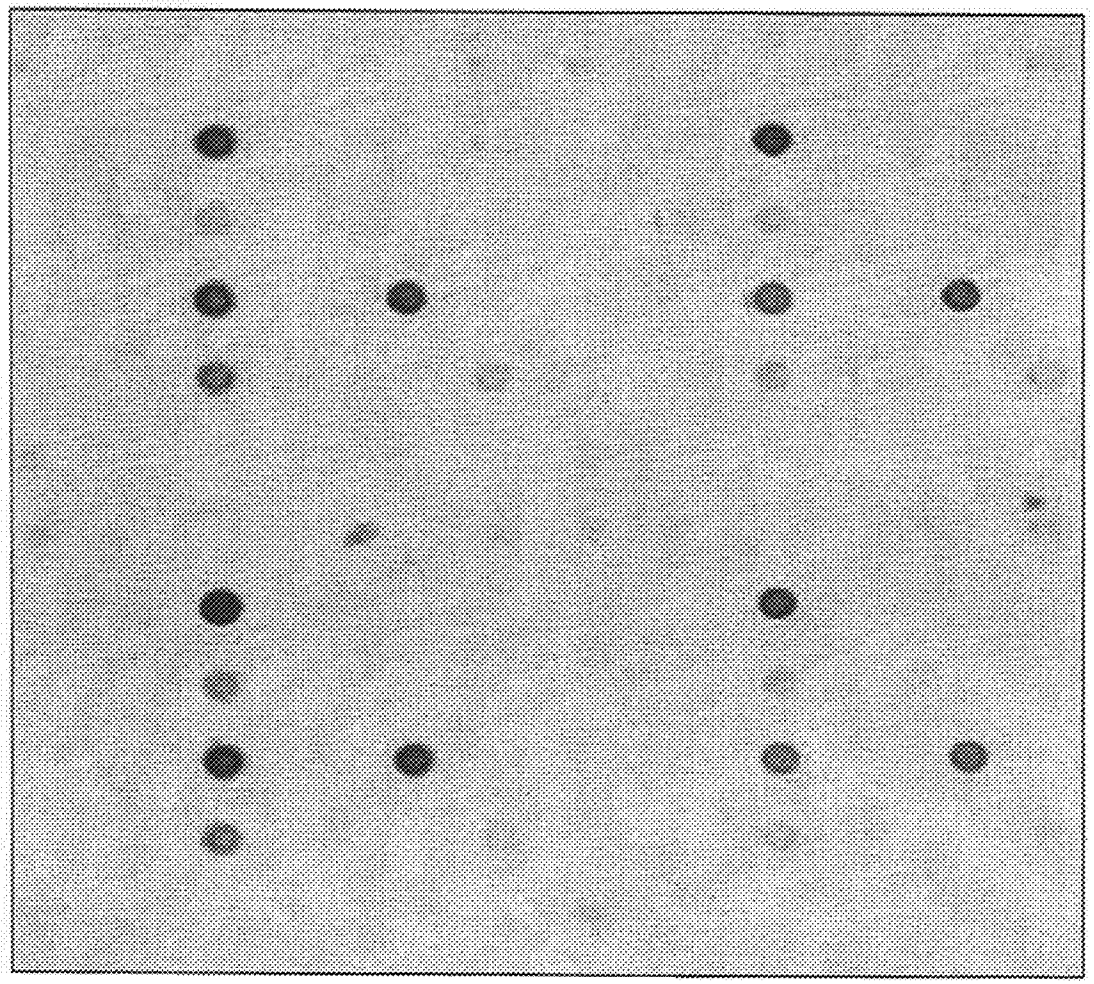
FIG. 13 shows the array image following TruTip processing of live MRSA, on-chip PCR, on chip washing, and image acquisition on a sample analysis system.

FIG. 13 shows a representative real-time PCR results following automated TruTip processing, using the system described herein, of live MRSA samples in water with a pre-conditioning step of magnetic lysing. Additional automated processing steps included subsequent filling of the microarray flow cell chamber with eluent and PCR Mastermix via a dome valve in the flow strip housing, closing the flow strip pin valves, insertion of the flow cell between the bladders of the thermal cycler, removal of the flow cell following thermal cycling, opening the pin valves, washing, drying with acetone, and imaging with the optical train shown in FIGS. 12A-12C. Six different probes were tested. FIG. 13 shows an example of the resultant image at an exposure time of 0.5 s. All five samples were detected with all probes using MCI software.

Another experiment included a test for the presence of MRSA across eight samples of live MRSA in NPA. Subsequent processing for all eight samples were performed as described above. Real-time PCR results of the automated processing on the system described herein are shown in Table 1 All MRSA was properly detected in all 8 samples using the image analysis algorithm described above.

TABLE 1

| Detection of live MRSA in NPA | | | | | | | | |
|---|---|---|---|---|---|---|---|---|
| | Sample ID | | | | | | | |
| Probe ID | NHT-1 | NHT-2 | NHT-3 | NHT-4 | NHT-5 | NHT-6 | NHT-7 | NHT-8 |
| MecA_29 | Detected | Detected | Detected | Detected | Detected | Detected | Detected | Detected |
| Staph Aureus_31 | Detected | Detected | Detected | Detected | Detected | Detected | Detected | Detected |
| SCCmecA_35 | Detected | Detected | Detected | Detected | Detected | Detected | Detected | Detected |
| SCCmecA_36 | Detected | Detected | Detected | Detected | Detected | Detected | Detected | Detected |
| SCCmecA_37 | Detected | Detected | Detected | Detected | Detected | Detected | Detected | Detected |
| M13_90 | Detected | Detected | Detected | Detected | Detected | Detected | Detected | Detected |

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims. The claims are intended to cover the components and steps in any sequence which is effective to meet the objectives there intended, unless the context specifically indicates the contrary.

What is claimed is:

1. A flow-control device, comprising:

a selector channel comprising a plunger channel and a plurality of outlet ports, and a linear motion actuator comprising:

an elongated shaft;

wherein the elongated shaft comprises a proximal end, a distal end, and an enclosed fluid communication channel within the elongated shaft, wherein the enclosed fluid communication channel extends from a first opening at the proximal end of the elongated shaft, forming an air inlet, to a second opening at the distal end of the elongated shaft, forming one or more air outlets, the air inlet is configured to be connected to a fluid source, and each of the one or more air outlets is flanked by two seals on the elongated shaft such that when the elongated shaft is positioned in the plunger channel of the selector channel, the two seals form an airtight seal against the interior wall of the selector channel and form a fluid communication passage between the two seals, wherein the fluid source and at least one of the plurality of the outlet ports of the selector channel are fluidically connected when the fluid communication passage is connected between at least one of the one or more air outlets and the at least one of the plurality of the outlet port; and a motor configured to control the linear movement of the elongated shaft in the plunger channel.

2. The flow-control device of claim 1, wherein the two seals on the elongated shaft are o-ring seals.

3. The flow-control device of claim 1, wherein the selector channel further comprises a vent.

* * * * *